US008053155B2

(12) United States Patent
Ariyoshi et al.

(10) Patent No.: US 8,053,155 B2
(45) Date of Patent: Nov. 8, 2011

(54) TONER, TWO-COMPONENT DEVELOPER, DEVELOPING DEVICE, AND IMAGE FORMING APPARATUS

(75) Inventors: Satoru Ariyoshi, Nara (JP); Kiyoshi Toizumi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 680 days.

(21) Appl. No.: 12/170,748

(22) Filed: Jul. 10, 2008

(65) Prior Publication Data

US 2009/0017395 A1 Jan. 15, 2009

(30) Foreign Application Priority Data

Jul. 13, 2007 (JP) ..... P2007-184798

(51) Int. Cl.
*G03G 9/00* (2006.01)

(52) U.S. Cl. ..... 430/110.1; 430/108.1; 430/110.4; 430/137.14

(58) Field of Classification Search ..... 430/110.1, 430/110.2, 110.3, 110.4, 108.1, 111.1, 137.14; 425/66

See application file for complete search history.

(56) References Cited

U.S. PATENT DOCUMENTS

| | | | | |
|---|---|---|---|---|
| 4,233,388 | A * | 11/1980 | Bergen et al. | 430/137.18 |
| 5,180,649 | A | 1/1993 | Kukimoto et al. | |
| 5,384,224 | A | 1/1995 | Tanikawa et al. | |
| 5,460,914 | A | 10/1995 | Sasaki et al. | |
| 5,707,771 | A | 1/1998 | Matsunaga | |
| 5,863,692 | A | 1/1999 | Nakamura et al. | |
| 6,248,491 | B1 | 6/2001 | Takayanagi et al. | |
| 6,316,157 | B1 | 11/2001 | Yoshikawa et al. | |
| 2004/0076443 | A1 * | 4/2004 | Suzuki et al. | 399/69 |
| 2004/0146309 | A1 | 7/2004 | Shu et al. | |
| 2004/0175641 | A1 * | 9/2004 | Nanya et al. | 430/109.4 |
| 2005/0196692 | A1 | 9/2005 | Yamashita et al. | |
| 2005/0202336 | A1 | 9/2005 | Kawase et al. | |
| 2006/0068314 | A1 * | 3/2006 | Kawata | 430/110.4 |
| 2006/0240350 | A1 * | 10/2006 | Shu et al. | 430/108.6 |

(Continued)

FOREIGN PATENT DOCUMENTS

JP 2-221967 9/1990

(Continued)

OTHER PUBLICATIONS

U.S. Office Action mailed May 19, 2009 in related U.S. Appl. No. 11/727,297.

*Primary Examiner* — Mark F Huff
*Assistant Examiner* — Stewart Fraser
(74) *Attorney, Agent, or Firm* — Nixon & Vanderhye P.C.

(57) ABSTRACT

A toner has columnar particles manufactured through: a kneading step of melt-kneading toner raw materials including at least binder resin, colorant and a release agent to prepare a kneaded product; a spinning step of extruding the kneaded product from orifices disposed at the tip of a spinning nozzle to prepare a fibrous kneaded product; and a pulverizing step of cutting or pulverizing the fibrous kneaded product, the toner matrix particles each having an aspect ratio of 0.5 to 5.0 and a $d_B/d_{50}$ value of 0.5 or above and contain an external additive composed of large particles and small particles having a volume average particle size smaller than that of the large particles, as well as to provide each of the columnar particles with each having 10 or less reentrants whose apertures have a longer length in a minor axis thereof than a radius of the respective large particles.

5 Claims, 8 Drawing Sheets

U.S. PATENT DOCUMENTS

| | | | | |
|---|---|---|---|---|
| 2007/0224533 | A1 | 9/2007 | Ariyoshi et al. | |
| 2008/0063968 | A1* | 3/2008 | Kinoshita et al. | 430/110.1 |
| 2008/0233506 | A1* | 9/2008 | Hagi et al. | 430/108.8 |
| 2009/0029279 | A1 | 1/2009 | Mori et al. | |

FOREIGN PATENT DOCUMENTS

| | | | |
|---|---|---|---|
| JP | 3-219262 | | 9/1991 |
| JP | 5-19527 | | 1/1993 |
| JP | 5-181322 | A | 7/1993 |
| JP | 5-249735 | A | 9/1993 |
| JP | 8-220810 | A | 8/1996 |
| JP | 8-234480 | A | 9/1996 |
| JP | 9-197704 | A | 7/1997 |
| JP | 10-90951 | A | 4/1998 |
| JP | 10-312089 | | 11/1998 |
| JP | 11-295922 | A | 10/1999 |
| JP | 11-295925 | A | 10/1999 |
| JP | 2000-10349 | A | 1/2000 |
| JP | 2001-142258 | | 5/2001 |
| JP | 2001-154398 | A | 6/2001 |
| JP | 2001-265048 | | 9/2001 |
| JP | 2002-169336 | A | 6/2002 |
| JP | 2002-189315 | | 7/2002 |
| JP | 2002-244348 | A | 8/2002 |
| JP | 2002-258523 | A | 9/2002 |
| JP | 2004-013049 | | 1/2004 |
| JP | 2004-191546 | | 7/2004 |
| JP | 2004-258625 | | 9/2004 |
| JP | 2005-173578 | A | 6/2005 |
| JP | 2005-181849 | A | 7/2005 |
| JP | 2005-316055 | A | 11/2005 |
| JP | 2006-84742 | A | 3/2006 |
| JP | 2006-113313 | | 4/2006 |
| JP | 2006-293160 | A | 10/2006 |
| JP | 2007-41496 | A | 2/2007 |
| JP | 2007-58134 | A | 3/2007 |

* cited by examiner

TONER, TWO-COMPONENT DEVELOPER, DEVELOPING DEVICE, AND IMAGE FORMING APPARATUS

CROSS-REFERENCE TO RELATED APPLICATION

This application claims priority to Japanese Patent Application No. 2007-184798, which was filed on Jul. 13, 2007, the contents of which are incorporated herein by reference in its entirety.

BACKGROUND OF THE INVENTION

1. Field of the Invention

The present invention relates to a toner for the use in developing electrostatic latent images in an electrophotographic image forming process or the like, a two-component developer, a developing device, and an image forming apparatus.

2. Description of the Related Art

The toner for the use in electrophotography can be obtained by a kneading pulverization method or a polymerization method such as a suspension polymerization method and an emulsion-polymerization aggregation method. In the kneading pulverization method, a toner raw material containing a binder resin and a colorant as main ingredients, in to which additives such as a charge control agent and a release agent are mixed as required, is melt-kneaded, then cooled to be solidified, and further pulverized and classified. To such a toner, inorganic fine particles such as fine-particle silica or aluminum oxide are generally added as external additives for the purpose of improving flowability and electrostatic charge stability.

In recent years, enhancement of image quality in the electrophotographic field has been studied from various angles. And there is a growing recognition that reduction in size of toner matrix particles is especially effective for enhancement of image quality. However, as toner matrix particles advance in size reduction, there develops a tendency that their flowability and transfer efficiency are lowered to result in formation of poor-quality images.

Such a tendency is brought to the fore in the case of forming full-color images in particular. In general, toners of subtractive primary colors, namely three colors of yellow (Y), magenta (M) and cyan (C), or toners of four colors including these three colors and black (B) are used for color reproduction in full-color image formation. The color reproduction procedure is, e.g., as follows, Electrification, exposure, development and transfer steps in an image forming process are repeated for each of C, M, Y and B colors, and then toner images thus formed on photoreceptors assigned for those colors respectively undergo primary transfer onto an intermediate transfer body in succession so that one color image is superposed upon another color image. Thereafter, a full-color image is formed on a recording medium by one-operation transfer of superposed toner images of multiple colors. In the final fixing step, the superposed toner images are fused and fixed into the recording medium.

In such full-color electrophotography, flowability and transfer efficiency of toner of each color become extremely important factors because development is carried out for plural times and in the transfer step, toner images are collectively performed in one operation. Therefore, to a toner small in particle size used in full color image formation, an external additive is often added which is composed of so large particles as having a volume average particle size of the order of 50 nm to 150 nm, for the purpose of enhancing flowability and transfer efficiency of the toner.

However, the external additive of large particles added to surfaces of toner matrix particles of the toner moves to reentrants in the surfaces of toner matrix particles of the toner and is deposited thereon and further embedded therein by various mechanical stresses applied to the toner through stirring in a developing device. Therefore, there occurs a problem that initial toner properties including the flowability and the chargeability the toner has at the time of initial use cannot be retained over the long term to result in degradation of image quality, such as background fog and inconsistencies in density.

When the kneading pulverization method is adopted, the reentrants in surfaces of toner matrix particles, where deposition and embedment of an external additive occur, are formed by the toner matrix particles undergoing stresses inside a device used in the pulverizing step and collisions between themselves. When the polymerization method such as an emulsion-polymerization aggregation method is adopted, on the other hand, those reentrants are formed of cavities among aggregated particles. In these reentrants, large ones with diameters reaching several μm are included.

In order to solve the problem, arts of reducing the number of reentrants in surfaces of toner matrix particles and smoothing the surfaces have been proposed. For exampler, in the case of the nonmagnetic toner disclosed in Japanese Unexamined Patent Publications JP-A 11-295922 (1999) and JP-A 11-295925 (1999), momentary heating treatment is given to toner particles so that the value obtained by dividing the reduced particle size D determined from their BET specific surface area by the 50% relative particle size $d_{50}$ of particle size-specific relative weight distribution becomes 0.20 or above. By this treatment, surface conditions of the toner particles improve in not only smoothness but also uniformity, surface properties of the toner particles are retained stably over the long term, and flowability and electrification properties required of the toner are obtained.

Although the momentary heating treatment is given to toner matrix particles with the intention of enhancing their surface smoothness in JP-A 11-295922 and JP-A 11-295925, there is a risk that the release agent incorporated in the toner bleeds from the toner surface by this momentary heating treatment and affects adversely durability of the toner. In addition, there is another risk that the fluidizing agent added is fixed to surfaces of toner matrix particles by such treatment, and pressed and embedded in the surfaces of toner matrix particles by stresses from, e.g., stirring inside the developing device, resulting in degradation in flowability. Furthermore, retention of a homogeneous dispersion state during the momentary heating treatment requires a greater amount of fluidizing agent than usual, and threatens to impair electrostatic charge stability.

SUMMARY OF THE INVENTION

The invention is made with a view to resolve these problems, and aims to provide a toner of which toner matrix particles each have a surface excellent in smoothness without undergoing heating treatment and which is highly stabilized in properties including flowability and chargeability, as well as to a two-component developer, a developing device, and image forming apparatus.

The invention provides a toner comprising columnar toner matrix particles manufactured through: a kneading step of melt-kneading toner raw materials including at least a binder resin, a colorant and a release agent to thereby prepare a kneaded product; a spinning step of extruding the kneaded product from orifices disposed at a tip of a spinning nozzle to thereby prepare a fibrous kneaded product; and a pulverizing step of cutting or pulverizing the fibrous kneaded product, the columnar toner matrix particles each having an aspect ratio H/L of 0.5 or more and 5.0 or less where L represents a length of longitudinal bottom surface of each of the columnar toner matrix particles and H represents a height of the respective columnar toner matrix particles, the columnar toner matrix particles having $d_B/d_{50}$ of 0.5 or above where $d_B$ represents a reduced particle size determined from a BET specific surface area and a true density and $d_{50}$ represents a particle size corresponding to a cumulative volume of 50% counted from a greater particle-size side in cumulative volume distribution, the toner further comprising an external additive composed of large particles and small particles having a volume average particle size smaller than that of the large particles, and the columnar toner matrix particles each having, in a surface thereof, 10 or less reentrants whose apertures have a longer length in a minor axis thereof than a radius of the respective large particles.

Here, the "toner matrix particle" means a toner particle without addition of any external additive.

The toner of the invention has columnar toner matrix particles manufactured through: a kneading step of melt-kneading toner raw materials including at least a binder resin, a colorant and a release agent to thereby prepare a kneaded product; a spinning step of extruding the kneaded product from orifices made at a tip of a spinning nozzle to thereby prepare a fibrous kneaded product; and a pulverizing step of cutting or pulverizing the fibrous kneaded product. Because it is manufactured by such a spinning method, the toner of the invention can ensure high smoothness at the surfaces of toner matrix particles without undergoing heating treatment or the like, compared with the toner manufactured by a kneading pulverization method or a polymerization method. Therefore, in the toner of the invention, external additives can be prevented from being deposited on and embedded in reentrants in the surfaces of toner matrix particles, with the result that changes in flowability and chargeability of the toner with a lapse of time during the long-term use can be curbed and that excellent stabilization of toner properties can be attained.

Further, in the toner of the invention, the columnar toner matrix particles each have an aspect ratio H/L of 0.5 or more and 5.0 or less where L represents a length of longitudinal bottom surface of the respective columnar toner matrix particles and H represents a height of the respective columnar toner matrix particles. By such an aspect ratio adjustment, the toner of the invention can be manufactured at a high yield. Further, the toner has small particles which exhibit narrower particle-size distribution and are thus more excellent in size uniformity, resulting in further improvement of the flowability and chargeability of the toner.

Further, in the toner of the invention, the columnar toner matrix particles have $d_B/d_{50}$ of 0.5 or above where dB represents a reduced particle size determined from a BET specific surface area and a true density and $d_{50}$ represents a particle size corresponding to a cumulative volume of 50% counted from a greater particle-size side in cumulative volume distribution. By having such a value, reentrants present in the surfaces of toner matrix particles are reduced in number, and deposition and embedment of external additives in such reentrants can be avoided. Consequently, changes in flowability and chargeability of toner with a lapse of time during the long-term use can be controlled, and stabilization of toner properties can be attained.

Further, the toner of the invention contains an external additive composed of large particles and small particles having a volume average particle size smaller than that of the large particles, and the columnar toner matrix particles each have, in a surface thereof, 10 or less reentrants whose apertures have a longer length in a minor axis thereof than a radius of the respective large particles. By satisfying these requirements, it becomes possible to fill most of the reentrants in toner matrix particle surfaces with large particles of the external additive and, even when small particles of the external additive move by stresses from, e.g., stirring inside the developing device, they can be prevented from becoming deposited on or embedded in reentrants in the toner matrix particle surfaces. Since such an effect as to inhibit embedment of the small particles is obtained, changes in flowability and chargeability of toner with a lapse of time during the long-term use can be curbed, and stabilization of toner properties can be attained with higher reliability.

Further, in the invention, it is preferable that the fibrous kneaded product has a loss elastic modulus G" of $10^5$ Pa or below at 120° C. and a toss elastic modulus G" of $10^1$ Pa or above at 200° C., and besides, the fibrous kneaded product has a loss tangent of 10 or below, where the loss tangent is defined as a value obtained by dividing the loss elastic modulus G" at 200° C. by a storage elastic modulus G' at 200° C.

According to the invention, the values of fiber diameter, loss elastic modulus G" and loss tangent of the fibrous kneaded product are specified as mentioned above, thereby making it a possible to prevent a phenomenon that stress generated by the external force applied in the pulverizing step is relaxed by deformation of the fibrous kneaded product, wherefore this toner ensures excellent pulverization efficiency in the pulverizing step. Therefore, the toner matrix particle surfaces can be smoothed to a sufficient extent, and changes in flowability and chargeability of toner with a lapse of time during the long-term use can be curbed more effectively, and more excellent stabilization of toner properties can be attained. In addition, the toner composed of small particles which exhibit narrow particle size distribution and are excellent in size uniformity can be obtained at a high yield.

Further, in the invention, it is preferable that content of the colorant is 10% by weight or below based on total raw materials of the toner.

According to the invention, the toner can be reduced in the filler effect by addition of colorant, and what is more, the toner having high coloring power can be obtained.

Further, in the invention, it is preferable that all of $S_A$ is $2.5\times10^5$ $nm^2$ or below, or the number of $S_A$ of $2.5\times10^5$ $nm^2$ or above is two or less in a bottom surface of one toner matrix particle, where $S_A$ represents an area of a dispersed release agent-existing spot in a bottom surface of each of the columnar toner matrix particles.

According to the invention, the release agent can be prevented from falling off the toner and being fused and bonded to other members inside a developing tank so that flowability of the release agent can be prevented from lowering.

The invention provides a two-component developer comprising the toner mentioned above and a carrier.

According to the invention, the two-component developer comprises the toner of which toner matrix particles have surfaces excellent in smoothness and which is highly stabilized in properties such as flowability and chargeability, and a carrier, with the result that the two-component developer can form high-quality images of high definition and high resolution without causing degradation in image quality even when toner's flowability and chargeability are changing with a lapse of time during the long-term use.

The invention provides a developing device performing a development by use of a developer containing the toner mentioned above.

According to the invention, the developing device performs the development using the developer containing the toner of which toner matrix particles have surfaces excellent in smoothness and which is highly stabilized in properties such as flowability and chargeability, so that toner images of high definition and high resolution can be formed on a photoreceptor.

The invention provides an image forming apparatus equipped with the developing device mentioned above.

According to the invention, the image forming apparatus is equipped with the developing device, so that high-quality images of high definition and high resolution can be formed without causing degradation in image quality even when toner's flowability and chargeability are changing with a lapse of time during the long-term use.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
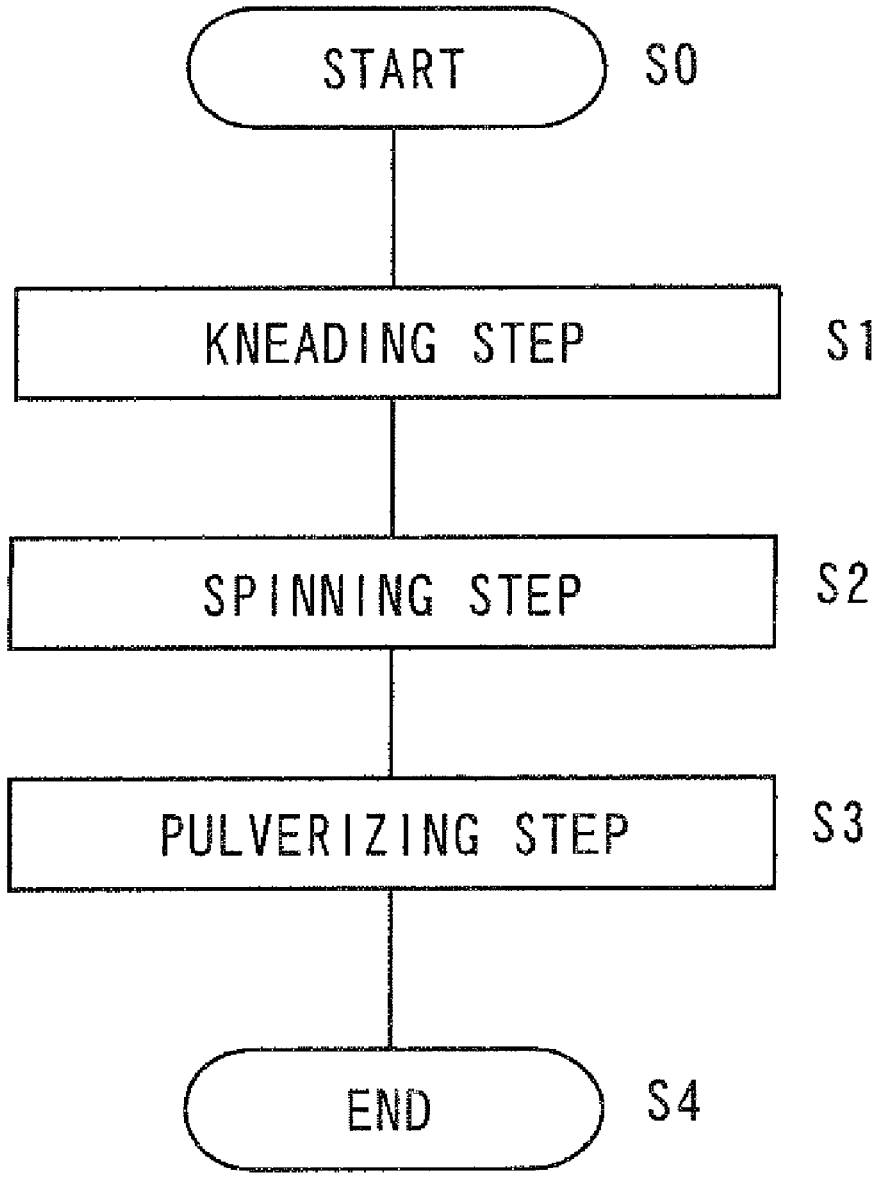
FIG. 1 is a flowchart showing a series of process steps in a method of manufacturing a toner of the invention.

Now referring to the drawings, preferred embodiments of the invention are described below.

Figure 2:
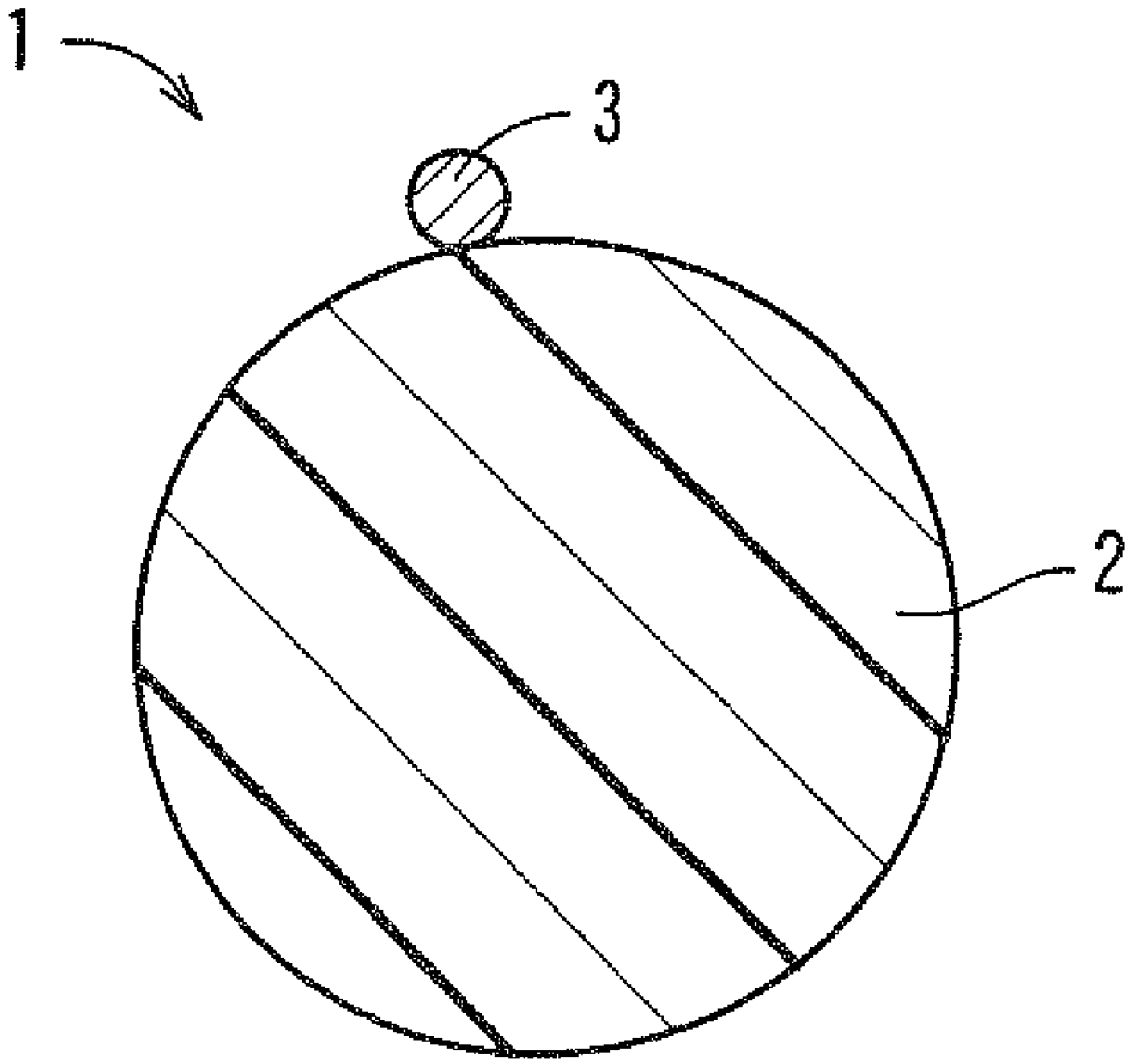
FIG. 2 is a schematic view of one of the toner matrix particles constituting the toner of the invention as viewed from a bottom surface of the toner matrix particle.

FIG. 1 is a flowchart showing a series of process steps in a method of manufacturing a toner 1 of the invention, and FIG. 2 is a schematic view of one of toner matrix particles constituting the toner 1 of the invention as viewed from a bottom surface of the toner matrix particle 2. The toner 1 of the invention includes columnar toner matrix particles manufactured through, as shown in FIG. 1*i* a kneading step (Step S1) of melt-kneading toner raw materials including at least a binder resin, a colorant and a release agent to prepare a kneaded product; a spinning step (Step S2) of extruding the kneaded product from orifices disposed at the tip of a spinning nozzle to prepare a fibrous kneaded product; and a pulverizing step (Step S3) of cutting or pulverizing the fibrous kneaded product.

The surface smoothness of toner matrix particles 2 of the toner 1 manufactured by the spinning method is determined by a spinning step and a pulverizing step. In the spinning step, the kneaded product obtained in the kneading step is made into a fibrous kneaded product by extrusion from orifices made at the tip of a spinning nozzle under a constant force and by cooling simultaneous with the extrusion. Therefore, the side of the toner matrix particle 2 constituting the toner 1 is less prone to form uneven spots. In the pulverizing step, on the other hand, the fibrous kneaded product is pulverized by a cleaving action so, the bottom surface of the toner matrix particle 2 constituting the toner 1 is also less prone to form uneven spots. Thus, the toner 1 can have, as shown in FIG. 2, higher smoothness at the surface of each toner matrix particle 2 without undergoing heating treatment, compared with the toner manufactured by a kneading pulverization method or a polymerization method. Accordingly, even when an external additive 3 moves by stresses from stirring or the like inside the developing device, the additive is avoided from depositing on or embedding in reentrants in the surface of each toner matrix particle 2, and changes in toner's flowability and chargeability with a lapse of time during the long-term use are curbed and toner properties are highly stabilized.

Because the spinning method makes it possible to control a fiber diameter of the fibrous kneaded product in the spinning step and a height of toner in the pulverizing step, a toner thus obtained cart be composed of small and uniform particles which are desirable in size and exhibit narrow particle size distribution. Therefore, the spinning method allows labor savings in the pulverizing step and reduction in proportion of off-grade particles in the toner 1, as compared with the kneading pulverization method. Further, it allows omission of a classifying step and reduction of time required for the manufacturing process. Furthermore, the yield of toner 1 is increased.

When the length in a longitudinal direction of the bottom surface of a toner matrix particle 2 is symbolized by L and the height of the toner matrix particle 2 is symbolized by H, the toner 2 has an aspect ratio as a value obtained by dividing H by L in a range of 0.5 to 5.0. By making such an aspect ratio adjustment, the toner 1 can be obtained at a high yield in the case of forming toner matrix particles by pulverizing the fibrous kneaded product. In addition, the toner obtained is a toner composed of small particles which are narrower in size distribution and higher in size uniformity, so the flowability and chargeability thereof become better. Because of its better flowability, the toner can have excellent effects on prevention of developer degradation caused by stresses from stirring and the lake in a developing tank and prevention of thickness reduction caused in an organic photoreceptor by stresses applied to the photoreceptor surface. When the aspect ratio falls outside the range specified above, the yield of the toner 1 is lowered and the toner obtained has a broad particle size distribution to result in flowability drop and chargeability degradation.

Additionally, the length in a longitudinal direction of the bottom surface of the toner matrix particle 2 is equivalent to the length of a diameter of the bottom surface when the bottom surface of the toner matrix particle 2 is circular in shape, it is equivalent to the length of a major axis of the bottom surface when the bottom surface of the toner 1 is elliptical in shape, and it is equivalent to the length of a long side of the bottom surface when the bottom surface of the toner matrix particle 2 is rectangular in shape.

Figure 3:
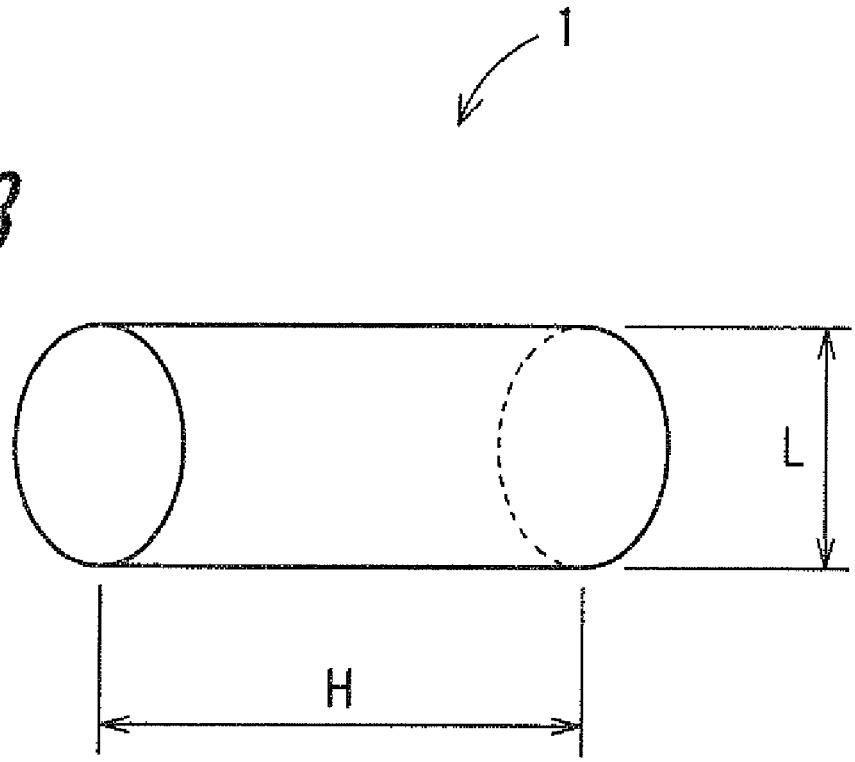
FIG. 3 is a schematic view showing one example of a toner matrix particle shape of the toner of the invention.

FIG. 3 is a schematic view showing one example of a particle shape of the toner 1 of the invention. When the shape of orifices made at the tip of a spinning nozzle used in the spinning step is a circular shape, the toner 1 will have a columnar shape as shown in FIG. 3. Assuming that the diameter of the bottom surface of the toner matrix particle constituting the toner 1 is symbolized by L and that the height of the toner matrix particle constituting the toner 1 is symbolized by H, the aspect ratio of the toner matrix particle constituting the toner 1 can be defined as H/L, or the value obtained by dividing H by L.

When the reduced particle size determined from the BET specific surface area $S_B$ ($m^2/g$) and true density ρ ($g/cm^3$) of the toner matrix particle constituting the toner 1 in accordance with the following expression (1) is symbolized by $d_B$ (μm) and the particle size corresponding to a cumulative volume of 50% from the greater particle-size side in cumulative volume distribution is symbolized by $d_{50}$ (μm), $d_B/d_{50}$ as the value obtained by dividing dB by $d_{50}$ is an index pointing out whether reentrants are present or not in the surface of each toner matrix particle 2. So, the greater this value, the smaller the number of reentrants present in the surface of each toner matrix particle 2.

$$dB=6/(\rho\sim S_B) \quad (1)$$

In the toner 1, the ratio $d_B/d_{50}$ is 0.5 or above. By such a $d_B/d_{50}$ ratio adjustment, the number of reentrants present in the surface of each toner matrix particle 2 becomes small, which makes it possible to prevent an external additive 3 from being deposited on and embedded in those reentrants. Therefore, changes in flowability and chargeability of toner with a lapse of time during the long-term use can be curbed and stabilization of toner properties can be attained. When the ratio $d_B/d_{50}$ is smaller than 0.5, the number of reentrants present on the surface of each toner matrix particle 2 becomes large. As a result, the surface smoothness of each toner matrix particle 2 is degraded, and the flowability and chargeability of toner becomes unstable.

Incidentally, the BET specific surface area $S_B$ ($m^2/g$) and the true density ρ ($g/cm^3$) are values measured with BET specific area measuring apparatus: NOVA4200e (trade name) manufactured by Yuasa Ionics Inc., and the $d_{50}$ is a value measured with particle-size distribution measuring apparatus: MULTISIZER III (trade name) manufactured by Beckman Coulter, Inc. Hereinafter, the above value $d_{50}$ signifies a volume average particle size.

The toner 1 includes an external additive 3 composed of large particles and small particles having a volume average particle size smaller than that of the large particles, and preferably the toner matrix particles 2 each have in a surface thereof, 10 or less reentrants whose apertures have a longer length in a minor axis thereof than a radius of the respective large particles, e.g., ranging from 25 nm to 75 nm. In this case, it becomes possible to fill most of reentrants present in the surface of each toner matrix particle 2 with the large particles and, even when the small particles move by stresses from stirring and so on inside the developing device, their deposition on and embedment in reentrants in the surface of each toner matrix particle 2 can be prevented. By ensuring inhibition of small particle embedment, changes in flowability and chargeability of toner with a lapse of time during the long-term use can be curbed and stabilization of toner properties can be attained with higher reliability. When the number of the reentrants is greater than 10, the effect of inhibiting embedment of the small particles cannot be obtained, so toner properties including flowability and chargeability become unstable. As to the kind and amount of an external additive 3 added, descriptions thereof are given hereinafter.

It is preferable that in the toner 1 of the invention, all of $S_A$ 2 is $2.5\times10^5$ $nm^2$ or below, or the number of $S_A$ of $2.5\times10^5$ $nm^2$ or above is two or less in a bottom surface of one toner matrix particle, where $S_A$ represents an area of a dispersed release agent-existing Spot in a bottom surface of each of the toner matrix particles 2. By doing so, lowering of the flowability caused by dropout of the release agent from the toner 1 and fusion bonding of the release agent to another member inside the developing tank can be prevented. When the number of release agent spots having $S_A$ of $2.5\times10^5$ $nm^2$ or above is greater than 2 in a bottom surface of one particle of the toner 1, occurrence of toner filming becomes pronounced.

Figure 4:
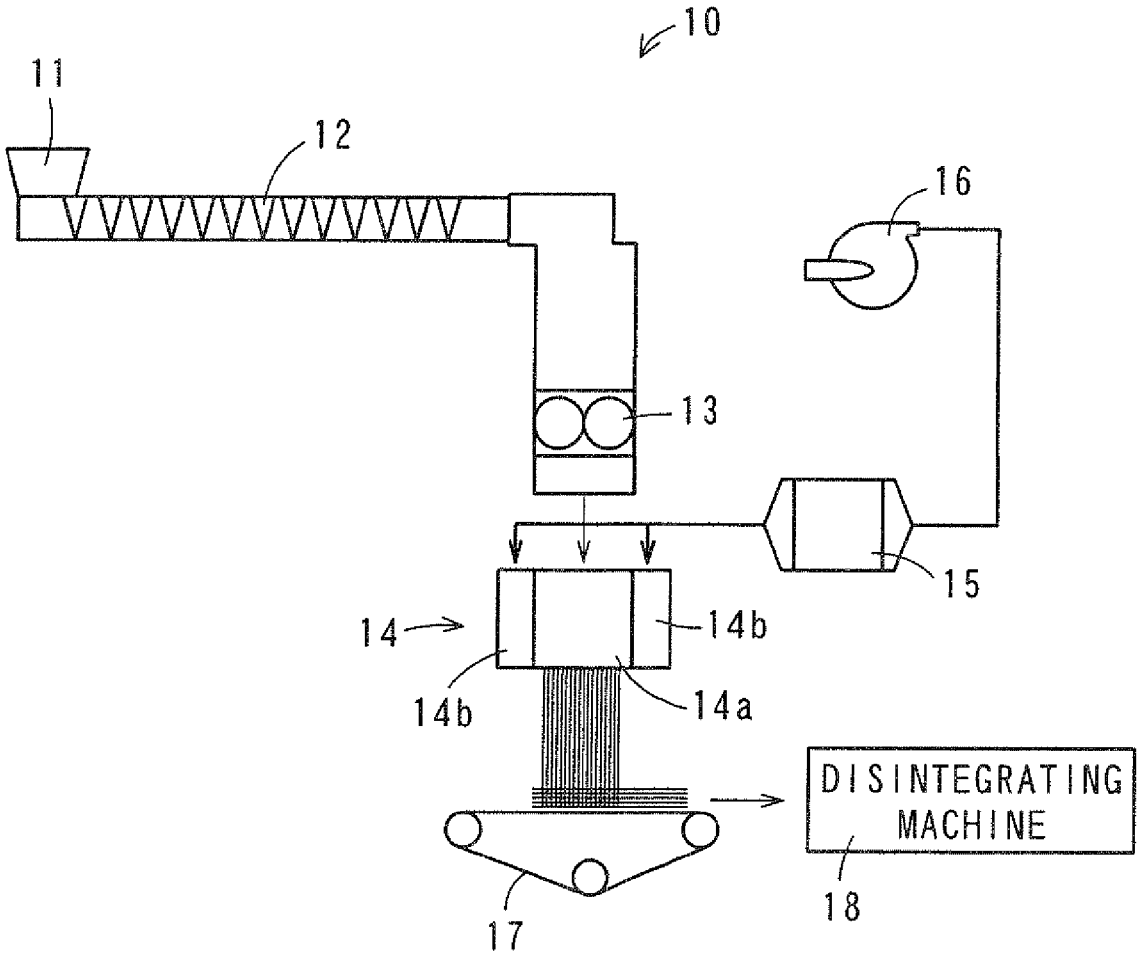
FIG. 4 is a schematic view showing one example of constitution of a toner manufacturing device used for manufacturing the toner of the invention.

Hereinafter, detailed explanations will be given to the respective production steps for manufacturing the toner 1 of the invention, including a kneading step (Step S1), a spinning step (Step S2), and a pulverizing step (Step S3). FIG. 4 is a schematic view showing one example of constitution of a toner manufacturing device 10 used for manufacturing the toner 1 of the invention. The shift from Step S0 to Step S1 initiates the process of manufacturing the toner 1 of the invention.

[Kneading Step]

The kneading step of Step S1 is performed in a raw material inlet 11 of the toner manufacturing device 10 and the twin-screw extruder 12 shown in FIG. 4.

Firstly, in the kneading step: of Step S1, toner raw materials containing at least a binder resin, a colorants and a release agent are preliminarily mixed in a mixer, and a raw material mixture thus obtained is put in the raw material inlet 11. The raw material mixture thus put is introduced into a kneading machine, i.e. r a twin-screw extruder 12, and molten, kneaded, and cooled down, resulting in a kneaded product. As above, the kneaded product can be obtained in which toner raw materials other than the binder resin are dispersed in the binder resin. The above toner taw materials may contain other toner additive components in addition to the binder resin, the colorant, and the release agent. The other toner additive components include a charge control agent, for example.

As the mixer used for mixing the toner raw materials, a known mixer can be used including, for example, a Henschel-type mixing device such as HENSCHELMIXER FM20C (trade name) manufactured by Mitsui Mining Co., Ltd., SUPERMIXER (trade name) manufactured by Kawata MFG Co., Ltd., MECHANOMILL (trade name) manufactured by Okada Seiko Co., Ltd., ANGMILL (trade name) manufactured by Hosokawa Micron Corporation, HYBRIDIZATION SYSTEM (trade name) manufactured by Nara Machinery Co., Ltd., and COSMOSYSTEM (trade name) manufactured by Kawasaki Heavy Industries, Ltd.

The kneading machine for melting and kneading toner raw materials is not limited to the twin-screw extruder 12, and known kneading machines may be used including, for example, an extruder kneading machine such as a kneader, a roller kneader, or a single-screw kneading machine, and a roll mill such as a two roll mill or a three roll mill. These kneading machines are available on the market, and commercialized products are, for example: KCK-L, KCK-26, KCK-32, KCK-42, KCK-52, KCK-62, KCK-72, KCK-82, and KCK-92 (all of which are model numbers) of Miracle K.C.K. (trade name) manufactured by Asada Iron Works. Co., Ltd.; TEM-100B (trade name) manufactured by Toshiba Machine Co., Ltd.; PCM-65/87 and PCM-30 (both of which are trade names) manufactured by Ikegai Ltd.; and KNEADEX (trade name) manufactured bay Mitsui Mining Co., Ltd. A plurality of the kneading machines may be used to knead the toner raw materials.

Further, the toner raw materials do not have to be preliminarily mixed by the mixer and may be put in the raw material inlet 11 as they are. It is however preferable to put the preliminarily mixed toner raw materials in the raw material inlet 11. When the toner raw materials are put in the raw material inlet 11 after preliminarily mixed by the mixer as above, the toner raw materials other than the binder resin can be dispersed more efficiently in the binder resin, and a toner having a certain property can be reliably obtained.

The above toner raw materials will be hereinafter explained.

(a) Binder Resin

For the binder resin, a commonly-used thermoplastic resin may be used including, for example, polyester resin, polyurethane resin, acrylic resin, and epoxy resin. These resin may be used each alone, or two or more of the resins may be used in combination. Further, it is possible to use two or more resins of the same type, which is different in any one or a plurality of molecular weight, monomer composition, and other properties.

The polyester resin is not particularly limited and a known material may be used such as a condensed polymer of polybasic acids and polyalcohols. Polybasic acids include polybasic acid and a derivative thereof represented by acid anhydride or esterified materials of polybasic acid. Polyalcohols indicate a chemical compound containing two or more hydroxyl groups, and include both of alcohols and phenols.

As polybasic acids, those known as monomers for polyester may be used including: aromatic carboxylic acids such as terephthalic acid, isophthalic acid, phthalic acid anhydride, trimellitic acid anhydride, pyromellitic acid, and naphthalene dicarboxylic acid; and aliphatic carboxylic acids such as maleic acid anhydride, fumaric acid, succinic acid, and adipic acid. The polybasic acids may be used each alone, or two or more of the polybasic acids may be used in combination.

As polyalcohols, those known as monomers for polyester may also be used including: aliphatic polyalcohols such as ethylene glycol, propylene glycol, butane diol, hexane diol, neopentyl glycol, and glycerin; alicyclic polyhydric alcohols such as cyclohexane diol, cyclohexane dimethanol, and hydrogenated bisphenol A; and aromatic diols such as an ethylene oxide adduct of bisphenol A and a propylene oxide adduct of bisphenol A. Herein, "bisphenol A" indicates 2,2-bis(p-hydroxyphenyl)propane. Examples of the ethylene oxide adduct of bisphenol A include polyoxyethylene-2,2-bis(4-hydroxyphenyl)propane. Examples of the propylene oxide adduct of bisphenol-A include polyoxypropylene-2,2-bis(4-hydroxyphenyl)propane. The polyalcohols may be used each alone, or two or more of the polyalcohols may be used in combination.

The polyester resin may be produced by the polycondensation reaction. The synthesis can be achieved by, for example, the polycondensation reaction, specifically, dehydration-condensation reaction, of polybasic acids and polyalcohols in the presence or absence of an organic solvent and in the presence of a catalyst. In this case, a part of the polybasic acids may be subjected to the de-methanol polycondensation reaction by using a methyl-esterified compound of polybasic acid. The polycondensation reaction of polybasic acids and polyalcohols may be terminated at the instant when the acid value and softening temperature of the resultant polyester stand at predetermined values. In the polycondensation reaction, by properly changing the blending ratio, reaction rate, or other conditions for the reaction, of the polybasic acids and the polyhydric alcohols, it is possible to adjust, for example, the terminal carboxyl group content of the resultant polyester resin and further to adjust the acid value of the resultant polyester, thereby allowing for adjustment of other properties such as the softening temperature.

The acrylic resin is not particularly limited either, and known acrylic resins may be used including, for example, a single polymer of acrylic monomers, and a copolymer of an acrylic monomer and a vinylic monomer. Among those, an acidic group-containing acrylic resin is preferred. As the acrylic monomer, substances customarily used for monomers of acrylic resin may be used including, for example, monomers of acrylic esters such as acrylic acid, methacrylic acid, methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, n-octyl acrylate, decyl acrylate, and dodecyl acrylate; and monomers of methacrylic esters such as methyl methacrylate, propyl methacrylate, n-butyl methacrylate, isobutyl methacrylate, n-amyl methacrylate, n-hexyl methacrylate, 2-ethylhexyl methacrylate, n-octyl methacrylate, decyl methacrylate, and dodecyl methacrylate. These acrylic monomers may each have a substituent. Examples of the acrylic monomer having a substituent include hydroxyl group-containing monomers of acrylic and methacrylic esters such as hydroxyethyl acrylate and hydroxypropyl methacrylate. The acrylic resin monomers may be used each alone, or two or more of the acrylic resin monomers may be used in combination. As the vinylic monomer, known substances may also be used including, for example, aromatic vinyl monomers such as styrene and α-methylstyrene; aliphatic vinyl monomers such as vinyl bromide, vinyl chloride, and vinyl acetate; and acrylonitrile-based monomers such as acrylonitrile and methacrylonitrile. The vinylic monomers may be used each alone, or two or more of the vinylic monomers may be used in combination.

The acrylic resin can be manufactured by polymerizing one or two or more of the acrylic monomers, or polymerizing one or two or more of the acrylic monomers and one or two or more of the vinylic monomers, in the presence of initiator of radical polymerization through a solution polymerization method, a suspension polymerization method, an emulsion-polymerization aggregation method, or the like method. The acidic group-containing acrylic resin can be manufactured by using either one or both of an acidic group- or hydrophilic group-containing acrylic monomer and an acidic group- or hydrophilic group-containing vinylic monomer in the polymerization of the acrylic monomers or the acrylic monomer and the vinylic monomer.

The polyurethane resin is not particularly limited either, and known polyurethane resins may be used including, for example, an addition polymer of polyol and polyisocyanate. Among those, acidic group- or basic group-containing polyurethane resin is preferred. The acidic group- or basic group-containing polyurethane resin can be produced by addition polymerization of acidic group- or basic group-containing polyol and polyisocyanate. Examples of the acidic group- or basic group-containing polyol include: diols such as dimethylol propionic acid and N-methyl diethanol amine; polyether polyol such as polyethylene glycol, and three or higher valent polyols such as polyester polyol, acryl polyol, and polybutadiene polyol. The polyols may be used each alone, or two or more of the polyols may be used in combination. Examples of polyisocyanate include tolylene diisocyanate, hexamethylene diisocyanate, and isophorone diisocyanate. The polyisocyanates may be used each alone, or two or more of the polyisocyanates may be used in combination.

The epoxy resin is not particularly limited either, and known resin may be used including, for example, bisphenol A epoxy resin produced based on bisphenol A and epichlorohydrin; phenol novolac-type epoxy resin produced based on a reaction product of phenol and formaldehyde, i.e., phenol novolac, and epichlorohydrin; and cresol novolac-type epoxy resin produced based on a reaction product of cresol and formaldehyde, i.e., cresol novolac, and epichlorohydrin. Among those, acidic group- or basic group-containing epoxy resin is preferred. The acidic group- or basic group-containing epoxy resin can be produced, for example, by addition or addition polymerization of polyvalent carboxylic acid such as adipic acid and trimellitic acid anhydride or amine such as dibutyl amine and ethylene diamine to the above epoxy resin which serves as a base.

Among the above resin, the polyester resin is preferably used for the binder resin. Since the softening temperature ($T_{1/2}$) of the polyester resin is lower than that of another resin such as the acrylic resin, the use of the polyester resin can result in a toner capable of being fixed at lower temperature, i.e., excellent in low-temperature fixing property. Moreover, the polyester resin has excellent translucency and therefore, the use of the polyester resin can result in a color toner which is excellent in chromogenic development as well as in secondary chromogenic development with a toner of another color.

The glass transition temperature (Tg) of the binder resin is not particularly limited and may be appropriately selected from a wide range. In view of a fixing property and preservation stability of the toner to be obtained, the glass transition temperature (Tg) is preferably 30° C. or more and 80° C. or less. The binder resin having a glass transition temperature (Tg) less than 30° C. may lead to insufficient preservation stability which increasingly causes thermal aggregation of the toner inside an image forming apparatus, possibly generating a development failures. Further, in this case, the high-temperature offset phenomenon will occur at lower temperature. The temperature at start of the high-temperature offset phenomenon will be hereinafter referred to as "high-temperature offset start temperature". The high-temperature offset phenomenon means a phenomenon indicating removal of a part of the toner which part is attached to a fixing member such as a heating roller when the toner layer is split due to the aggregating forces of toner matrix particles decreasing to be lower than the adhesion between the toner and the fixing member since the toner is excessively heated during fixing operation that the toner is heated and pressurized by the fixing member to be fixed to a recording medium. Further, the binder resin having a glass transition temperature (Tg) exceeding 80° C. may decrease the fixing property, thus causing a fixing failure.

A softening temperature ($T_{1/2}$) of the binder resin is not particularly limited and may be appropriately selected from a wide range, being preferably 150° C. or less and more preferably 60° C. or more and 120° C. or less. The binder resin having a softening temperature ($T_{1/2}$) less than 60° C. may decrease the preservation stability of the toner and increasingly cause the thermal aggregation of the toner inside the image forming apparatus, causing a failure to stably supply the toner to an image bearing member and thus causing a development failure. Further, malfunction of the image forming apparatus may be induced. The binder resin having a softening temperature ($T_{1/2}$) exceeding 120° C. is less easily molten in the kneading step, therefore making it difficult to knead the toner raw materials and possibly leading to a decrease in the dispersibility of the colorant, release agent, and charge control agent in the kneaded product. Furthermore, the toner becomes less easily molten or softened when being fixed to a recording medium and therefore, a fixing property of the toner to the recording medium may decrease and thus cause a fixing failure.

As above, the toner raw materials are preliminarily mixed in the mixer and then kneaded with the binder resin being molten in the kneading machine. Accordingly, after the toner raw materials are preliminarily mixed in the mixer, the toner raw materials are heated to the softening temperature of the binder resin or more and less than the decomposition temperature of the binder resin, to be specific, 80° C. or more and 200° C. or and preferably 120° C. or more and 200° C. or less so that the binder resin is molten, thereafter being kneaded and thus forming a kneaded product.

A molecular weight of the binder resin is not particularly limited and may be appropriately selected from a wide range. The weight average molecular weight (Mw) is preferably 5,000 or more and 500,000 or less. The binder resin having the weight average molecular weight less than 5,000 has decreased mechanical strength and results in toner matrix particles which are easily pulverized, for example, by agitation inside the developing device and of which shapes will change and possibly cause fluctuation in chargeability. The binder resin having the weight average molecular weight more than 500,000 is less easily molten, therefore making it difficult to knead the toner raw materials and possibly leading to a decrease in the dispersibility of the colorant, release agent, and charge control agent in the kneaded product. Further, a fixing property of the toner to the recording medium may decrease and thus cause a fixing failure, Note that the weight average molecular weight of the binder resin is polystyrene equivalency measured by use of gel permeation chromatography (abbreviated as GPC).

(b) Colorant

Examples of the colorant include dye and pigment among which the pigment is preferably used. The pigment is excellent in light resistance and chromogenic development as compared to the dye. The use of the pigment therefore results in a toner which is excellent in the light resistance and the chromogenic development. Specific examples of the colorant include colorant of respective colors as follows. Hereinbelow, the color index will be abbreviated as "C.I.".

Blue colorant includes, for example, organic pigments such as KET.BLUE 111, C.I. pigment blue 15, C.I. pigment blue 15:2, C.I. pigment blue 15:3, C.I. pigment blue 16, and C.I. pigment blue 60.

Black colorant includes, for example, inorganic pigments such as carbon black, copper oxide, manganese dioxide, activated carbon, non-magnetic ferrite, and magnetic ferrite represented by magnetite, and organic pigments such as aniline black.

Yellow colorant includes, for example, organic pigments such as C.I. pigment yellow 17, C.I. pigment yellow 74, C.I., pigment yellow 93, C.I. pigment yellow 155, C.I. pigment yellow 180, and C.I. pigment yellow 185.

Orange colorant includes, for example, organic pigments such as permanent orange GTR, pyrazolone orange, vulcan orange, indanthrene brilliant orange GK, benzidine orange G, indanthrene brilliant orange GK, C.I. pigment orange 31, and C.I. pigment orange 43.

Red colorant includes, for example, organic pigments such as C.I. pigment red 19, C.I. pigment red 48:3, C.I. pigment red 57:1, C.I. pigment red 122, C.I. pigment red 150, and C.I. pigment red 184.

Purple colorant includes, for example, inorganic pigments such as manganese purple, and organic pigments such as fast violet B, and methyl violet lake.

Green colorant includes, for example, inorganic pigments such as malachite green lake, and organic pigments such as pigment green B, final yellow green G, and C.I. pigment green 7.

White colorant includes, for example, inorganic pigments such as zinc oxide, titanium oxide, antimony white, and zinc sulfide.

These colorants may be used each alone, or two or more of the colorants of different colors may be used in combination. Further, a plurality of the colorants of the same color series may be used in combination. The content of the colorant is preferably 10% by weight or less of the total quantity of toner raw materials. When the content of the colorant falls within in the above ranger the filler effect attributable to addition of the colorant can be small, and a toner having high tinting strength can be obtained. When the content of the colorant exceeds 10% by weight, the filler effect of the colorant may lead to an increase in a storage elastic modulus G' at high temperature and result in a decrease in a fixing property of the toner.

(c) Release Agent

The release agent is added for providing a toner with a releasing property when the toner is fixed to a recording medium. The addition of the release agent can therefore increase a high-temperature offset start temperature and enhance an anti-high-temperature offset property as compared to those in the case where no release agent is used. Moreover, the heat used for fixing the toner can melt the release agent and decrease the melt viscosity of the toner, with the result that a low-temperature offset start temperature can be lower and that an anti-low-temperature offset property can be enhanced.

As the release gent, those customarily used in the relevant field may be used including, for example, wax. Examples of the wax include: natural wax such as carnauba wax and rice wax; synthetic wax such as polypropylene wax, polyethylene wax, and Fischer-Tropsch wax; coal wax such as montan wax; petroleum wax such as paraffin wax; alcohol wax; and ester wax. One of the release agents may be used each alone, or two or more of the release agents may be used in combination. The content of the release agent is not particularly limited and may be appropriately selected from a wide range in accordance with various conditions such as kinds and contents of the other components including the binder resin and the colorant, and properties required for a resultant toner. The preferable content of the release agent is 3 parts by weight or more and 10 parts by weight or less based on 100 parts by weight of the binder resin. The content of the release agent less than 3 parts by weight may lead to insufficient effects of enhancing the low-temperature fixing property and anti-high-temperature offset property. The content of the release agent more than 10 parts by weight may lead to a decrease in the dispersibility of the release agent into the kneaded product and may cause a failure to stably form toners exhibiting certain performance. Further, in this case, there may appear more frequently a phenomenon called toner filming that the toner is fused in a film-like form on a surface of an image bearing member such as a photoreceptor.

A melting temperature (Tm) of the release agent is preferably 50° C. or more and 150° C. or less and more preferably 120° C. or less. The release agent having a melting temperature less than 50° C. may be molten and cause toner matrix particle-to-particle aggregation inside a developing device or may cause a failure such as the toner filming on a surface of a photoreceptor. The release agent having a melting temperature exceeding 150° C. may not be able to sufficiently elute when the toner is fixed to a recording medium, possibly causing a failure to exert a sufficient effect of enhancing the anti-high-temperature offset property. The melting temperature of the release agent represents a temperature at an endothermic peak corresponding to meltdown of the DSC curve obtained through measurement of differential scanning calorimetry (abbreviated as "DSC").

(d) Charge Control Agent

The charge control, agent is added for controlling the charging property of the toner. For the charge control agent, those customarily used in the relevant field may be used including, for example, calixarenes, a quaternary ammonium salt compound, a nigrosine-based compound, an organic metal complex, a chelate compound, salicylate metal salt such as zinc salicylate, and a polymer obtained by single polymerization or copolymerization of monomers each having an ionizable group such as a sulfonate group or an amino group. The charge control agents may be used each alone, or two or more of the charge control agents may be used in combination. The content of the charge control agent is not particularly limited and may be appropriately selected from a wide range in accordance with various conditions such as kinds and contents of the other components including the binder resin and the colorant, and properties required for a resultant toner. The preferable content of the charge control agent is 0.5 part by weight or more and 5 parts by weight or less based on 100 parts by weight of the binder resin.

<Spinning Step>

The spinning step of Step S2 is a process of making a fibrous kneaded product by extruding a kneaded product prepared in the kneading step S1 from orifices 14*a* made at the tip of spinning nozzle 14, which is carried out using a gear pump 13, a spinning nozzle 14, a hot-air heater 15 and a hot-air blower 16 installed in toner manufacturing apparatus 10 shown in FIG. 4.

In the spinning step of Step S2, to begin with, pressure is applied by means of a gear pump 13 to the kneaded product prepared in the kneading step of Step S1, and the resultant kneaded product is fed into a spinning nozzle 14 having nozzle orifices 14*a* and hot-air discharge outlets 14*b*. The kneaded product fed into the spinning nozzle 14 is heated up to a temperature of, e.g., 120° C. to 200° C. by hot air, which is generated by the hot-air heater 15 and the hot-air blower 16 and discharged from the hot-air discharge outlets 14*b*, and extruded from the nozzle orifices 14*a*, together with the hot air, and thereby made into a fibrous kneaded product.

The temperature range of 120° C. to 200° C., which is controlled by the hot-air heater 15 and the hot-air blower 16, is equivalent to a range of the softening temperature to a temperature lower than the thermal decomposition temperature of binder resin in the toner.

The gear pump 13 is a device for feeding the kneaded product into the spinning nozzle 14, and the pressure applied to the kneaded product (hereinafter referred to as extrusion pressure) can be adjusted by controlling a discharge rate (cc/min) of the pump. In the invention, the extrusion pressure signifies the pressure at the outlets of the spinning nozzle 14, and as the extrusion pressure rises, the fiber diameter of a fibrous kneaded product becomes smaller. The extrusion pressure is preferably adjusted to a range of 0.5 MPa to 8.0 MPa. By such an extrusion pressure adjustment, the fibrous kneaded product having the desired fiber diameter can be made, and it becomes possible to manufacture a toner composed of small particles which are narrower in size distribution and excellent in size uniformity. Therefore, a classifying step can be omitted in contrast to a kneading pulverization method, so a further increase in yield can be attained. When the extrusion pressure is smaller than 0.5 MPa, the fibrous kneaded product made comes to have a fiber diameter greater than the intended fiber diameter, and not only the fibrous kneaded product having the intended fiber diameter cannot be obtained but also fiber breakage occurs frequently to result in loss of uniformity in fiber diameter of the fibrous kneaded product. On the other hand, when the extrusion pressure is greater than 8.0 MPa, there is a risk that devices including the spinning nozzle 14 cannot withstand the extrusion pressure and get corrupted.

The device for feeding the kneaded product into the spinning nozzle 14 is not limited to the gear pump 13 in particular, and it may be, e.g., a screw pump, a diaphragm pump or a piston pump.

Figure 5B:
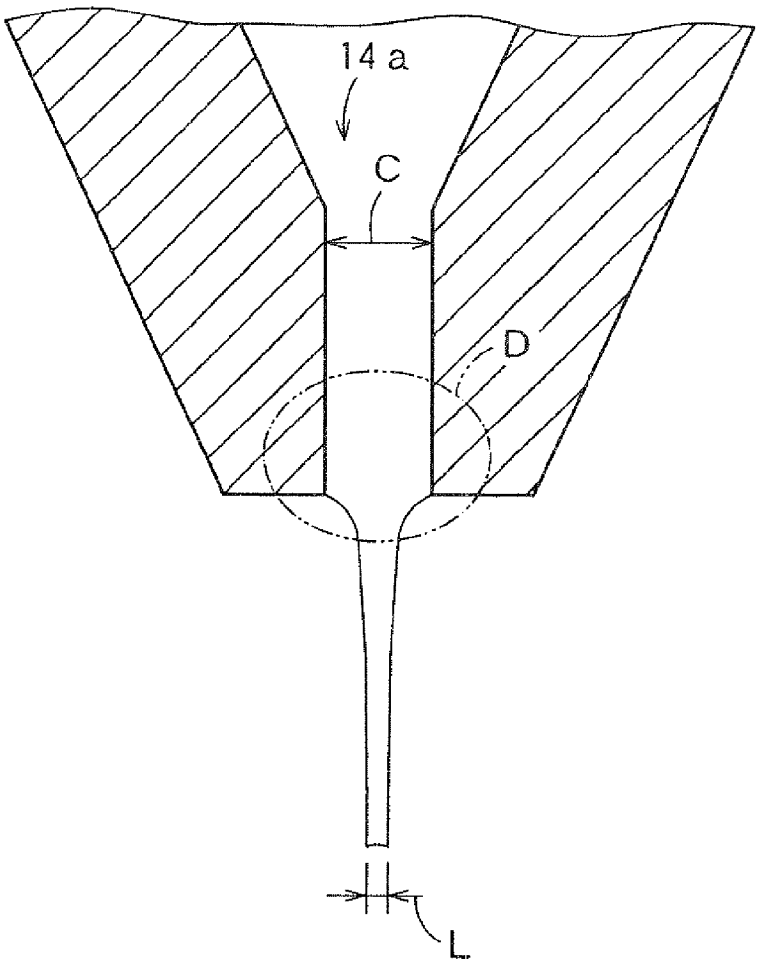
FIGS. 5A and 5D are schematic views each showing constitution of a spinning nozzle.
Figure 5A:
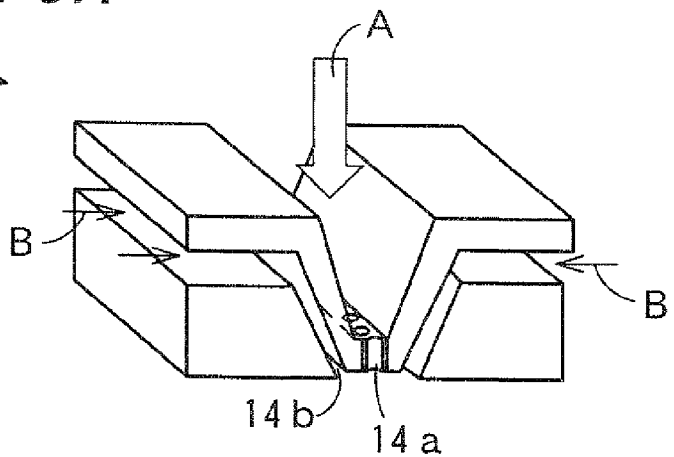

The spinning nozzle 14 is a device for making a fibrous kneaded product from the kneaded product FIGS. 5A and 5B are schematic views each showing constitution of the spinning nozzle 14. FIG. 5A is a sectional perspective view showing the constitution of the spinning nozzle 14, and FIG. 5B is a magnified view showing a nozzle orifice 14*a*.

The spinning nozzle 14, as shown in FIG. 5A, may be configured so as to have 10 circular nozzle orifices 14*a* aligned in a row like a harmonica, and thereby a fibrous kneaded product composed of 10 fibers can be prepared. The configuration of the spinning nozzle 14 is not limited to the foregoing. For example, the nozzle orifices 14*a* may be configured like a honeycomb, and each nozzle orifice 14*a* may be square or hexagonal in shape.

It is preferable that each nozzle orifice 14*a* is made so as to have its inside diameter shown by the double-headed arrow C in FIG. 5B in a range of 120 μm to 300 μm. By making nozzle orifices 14*a* each having the specified inside diameter in the spinning nozzle 14, a fibrous kneaded product having the desired fiber diameter can be made, and a toner composed of small particles which are narrower in size distribution and excellent in size uniformity can be manufactured. Therefore, a classifying step can be omitted, and a higher yield can be attained as compared with the kneading pulverization method. Since a kneaded product of toner raw materials has very high viscoelasticity, the kneaded product declines in ability to pass through the spinning nozzle 14 when the inside diameter of each nozzle orifice 14*a* is smaller than 120 μm to result in frequent breakage of fibers and variations in fiber diameter. When the inside diameter of each nozzle orifice is greater than 300 μm, on the other hand, a fibrous kneaded product having a fiber diameter greater than the intended fiber diameter is formed even when the maximum extrusion pressure, such as 10 MPa, is applied, so it becomes impossible to obtain a fibrous kneaded product having the desired fiber diameter.

The hot-air heater 15 and the hot-air blower 16 constitute a heating section for generating hot air, and a kneaded product is heated by the hot air, which is generated in the heating section, fed in the direction of the arrows B shown in FIG. 5A and discharged from hot-air discharge outlets 14*b*, at the time when the kneaded product is fed into the spinning nozzle 14 in the direction of the arrow A shown in FIG. 5A and made into a fibrous kneaded product. Because the hot-air heater 15 and the hot-air blower 16 allow hot-air heating of the kneaded product in the foregoing manner, solidification and rupture of the kneaded product can be avoided.

The hot-air beater 15 may be a commonly used heater, and it is not limited to particular one. One example thereof may be a coil heater having a heating element in coil form. The hot-air blower 16 may also be a commonly used blower, and it is not limited to particular one. As one example thereof, a propeller fan can be given.

The temperature regulated by the hot-air heater 15 and the hot-air blower 16, or the temperature at outlets of the spinning nozzle 14 which are shown, e.g., as a region D in FIG. 5B (hereinafter referred to as the outlet temperature), is preferably in a range of 120° C. to 200° C., which is comparable with temperatures equal to or higher than the softening temperature of binder resin in the toner, and that lower than the thermal decomposition temperature of the binder resin. One example of a method of controlling the outlet temperature is a method in which the outlet temperature is measured with a thermometer (not shown) and a controller (not shown) controls operations of the hot-air heater 15 and the hot-air blower 16 on a basis of the temperature inputted from the thermometer so that the outlet temperature measured with the thermometer becomes equal to the setting temperature inputted in advance.

Additionally, the kneaded product fed into the spinning nozzle 14 may be a kneaded product in a molten state or softened state as it is, or the product solidified by cooling after the kneading process may be used as it is or after the solidified product is restored to a molten or softened state by reheating.

<Pulverizing Step>

The pulverizing step of Step S3 is a process of manufacturing toner by cutting or pulverizing the fibrous kneaded product made in the spinning step of Step S2, and carried out by means of a belt conveyer 11 and a disintegrating machine 18 installed in the toner manufacturing apparatus 10 shown in FIG. 4.

In the pulverizing step of Step S3, the fibrous kneaded product made in the spinning step of Step S2 is fed into the disintegrating machine 18 by means of the belt conveyer 17, and cut or pulverized in the machine, thereby yielding toner matrix particles.

The disintegrating machine 18 has no particular limitation so long as it is a machine capable of cutting or pulverizing the fibrous kneaded product and making classification, and a suitable example thereof may be a mechanical pulverizing machine with a built-in pulverizing rotor for a pulverizer and a built-in classifying rotor for a classifier. The structure of the pulverizing machine is not limited to the foregoing one. For instance, the pulverizer may be a jet pulverizer, such as a spiral-flow jet mill or a collision-plate jet mill, or a rotary mechanical mill. And the structure of the classifier is not limited to the foregoing one, too. For instance, the classifier may be a pneumatic classifier, an inertia classifier or a screen classifier.

To the toner matrix particles 2 is added an external additive 3 capable of playing various functions, such as improvements in flowability of powder, triboelectrification and heat resistance, betterments of long-term storage stability and cleaning property, and control on an abrasion property of a photoreceptor surface. As the external additive 3, known additives in fine powder form may be used, with examples including fine particles of metal oxides, such as silica, titanium, alumina, magnetite and ferrite, and fine particles of metal nitrides, such as silicon nitride and boron nitride. Moreover, it is preferable that the surfaces of these particles are made hydrophobic by treatment. Examples of treatment for imparting hydrophobicity to the particle surface include treatment with a silane coupling agent, such as dimethyldichlorosilane or amylosilane, treatment with silicone oil and treatment with a fluorine-containing ingredient or so on. As the external additive 3, those additives may be used each alone, or two or more of them may be used in combination. Of those additives, silica is more suitable for use as the external additive 3. When fine particles other than silica are added exclusively, there may be cases where sufficient electrostatic charge is not built up by contact between a toner and a carrier. In addition, silica can also function as a fluidizing agent for toner, so the feed rate of toner can be stabilized by addition of silica.

The suitable amount of an external additive 3 added is 7 parts by weight or below based on 100 parts by weight of toner matrix particles 2 with consideration given to the amount of electrostatic charge required for toner, effect of addition of the external additive upon abrasion of the photoreceptor surface, an ecological property of toner and so on.

The external addition of the external additive 3 to toner matrix particles 2 is carried out by adding the external additive 3 to the toner matrix particles 2 obtained by pulverization, and stirring and mixing them by means of a high-speed stirrer, such as HENSCHELMIXER or SUPERMIXER. The mixing conditions including the number of revolutions of the stirrer used, the mixing time and the shape of vanes are chosen appropriately to suit the toner performance intended.

It is preferable that the external additive 3 contains particles having different volume average sizes, specifically large particles having a volume average size in a range of 50 nm to 150 nm and small particles having a volume average size smaller than 50 nm.

The large particles and the small particles constituting the external additive 3 may be the same in kind, or the large particles of one kind and the small particles of another kind may be included in the external additive 3.

The content of the large particles is preferably from 0.05 parts by weight to 2 parts by weight based on 100 parts by weight of toner matrix particles 2. And the content of the small particles is preferably from 0.05 parts by weight to 5 parts by weight based on 100 parts by weight of toner matrix particles 2.

Figure 6B:
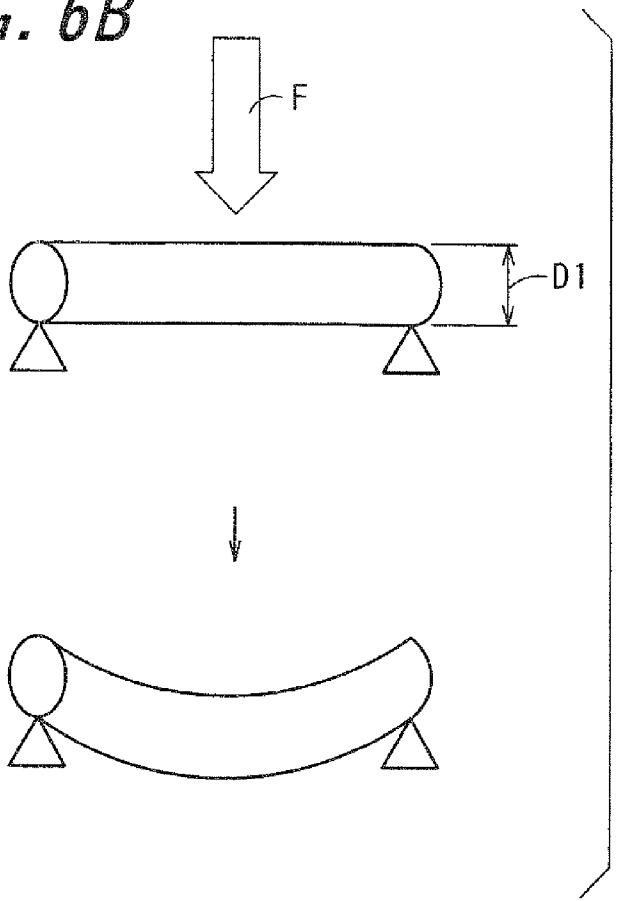
FIGS. 6A and 6B are schematic views each showing a fibrous kneaded product being pulverized in a pulverizing step.
Figure 6A:
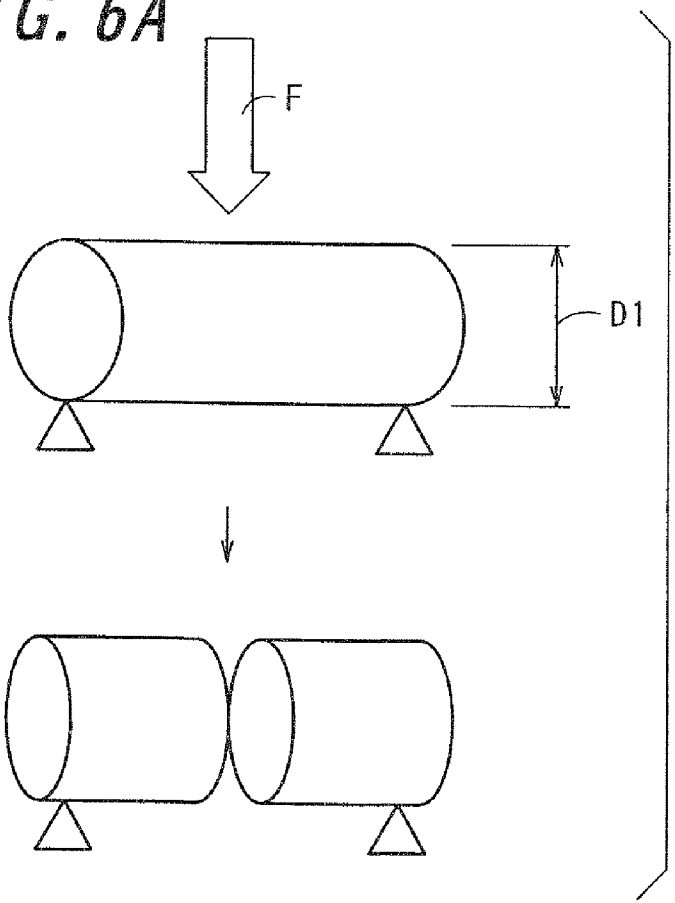

FIGS. 6A and 6B are schematic views each showing a fibrous kneaded product being pulverized in the pulverizing step. FIG. 6A is a schematic view showing a pulverized state of the fibrous kneaded product having a fiber diameter D1 of a certain value or above, while FIG. 6B is a schematic view showing a pulverized state of the fibrous kneaded product having a fiber diameter D1 smaller than a certain value.

As shown in FIG. 6A, a fibrous kneaded product is pulverized by the external force F applied during the pulverizing step when the fibrous kneaded product has a fiber diameter D1 of a certain value or above. On the other hand, as shown in FIG. 6B, a fibrous kneaded product having a fiber diameter D1 smaller than a certain value becomes flexible, so that stress generated by the external force F applied during the pulverizing step is relaxed by deformation of the fibrous kneaded product to result in lowering of pulverizability. Therefore, it becomes necessary to repeat pulverization over and over again for attainment of the desired toner particle size, what's worse the proportion of fines as offgrade toner becomes high. As a result, increases in labor and time required for classification after the pulverization are caused, and the toner yield is reduced too.

For attainment of excellent pulverizability in the pulverizing step, it is appropriate that the fiber diameter D1 of a fibrous kneaded product be specified so as to ensure a proper value of bending strength for the fibrous kneaded product.

The fiber diameter D1 of a fibrous kneaded product made in the spinning step is preferably from 5 μm to 10 μm. When the fiber diameter D1 is smaller than 5 μm, the fibrous kneaded product becomes flexible, and it becomes difficult to pulverize the fibrous kneaded product in the pulverizing step. When the fiber diameter D1 is larger than 10 μm, on the other hand, toner having a desired volume average particle size cannot be obtained.

In general the bending strength varies depending on materials used and physical properties inherent in them. In the case of a fibrous kneaded product made during the manufacturing of a toner, a change caused in bending strength by variations in toner raw materials and formulas for compounding them is small so long as those variations are not great. However, the bending strength of a fibrous kneaded product varies greatly depending on the loss elastic modulus G" and loss tangent of the fibrous kneaded product, wherein the loss tangent is a value obtained by dividing a loss elastic modulus G" by a storage elastic modulus G'.

As to the fibrous kneaded product, it is therefore preferable that the loss elastic modulus G" and the loss tangent as the value obtained by dividing a loss elastic modulus G" by a storage elastic modulus G' are specified. More specifically, it is preferable that the loss elastic modulus G" at 120° C. is adjusted to $10^5$ Pa or below, the loss elastic modulus G" at 200° C. to $10^1$ Pa or above, and the loss tangent to 10 or below, wherein the loss tangent is the value obtained by dividing a loss elastic modulus G" at 200° C. by a storage elastic modulus G' at 200° C. By designing the fibrous kneaded product so as to have the specified values of fiber diameter, loss elastic modulus G" and loss tangent, it becomes possible to avoid the phenomenon that stress generated by the external force applied in the pulverizing step is relaxed by deformation of the fibrous kneaded product, and high pulverization efficiency can be attained in the pulverizing step. As a result, the surfaces of toner matrix particles 2 can be smoothed to a sufficient degree, so changes in flowability and chargeability of a toner with a lapse of time during the long-term use can be inhibited effectively, and a toner with highly stabilized properties can be obtained. In addition, a toner composed of small particles which are narrow in size distribution and excellent in size uniformity can be obtained at a high yield.

When the loss elastic modulus G" at 120° C. is greater than $10^5$ Pa, the viscoelasticity of the kneaded product becomes too high, so the kneaded product is difficult to spin into fiber in the spinning step and there is a risk that the surface smoothness of toner matrix particles 2 is degraded. In addition, the viscosity of molten toner becomes high, and low-temperature offset resistance is lowered. Therefore, there is a risk that low-temperature offset occurs and poor fixing of toner is caused. When the loss elastic modulus G" at 200° C. is lower than $10^1$ Pa, the fibrous kneaded product becomes flexible, the fibrous kneaded product is difficult to pulverize in the pulverizing step, and there is a risk that the surface smoothness of toner matrix particles is degraded. In addition, the release agent becomes prone to fall off the toner, and high-temperature offset resistance is degraded. Therefore, there is a risk that high-temperature offset occurs and poor fixing, of toner is caused. Further, the loss tangent greater than 10 at 200° C. threatens to degrade high-temperature offset resistance.

Incidentally, the storage elastic modulus G' is a value signifying the elasticity of a sample, and the loss elastic modulus G" is a value signifying the viscosity of a sample. The loss tangent (tan δ) as the ratio between loss elastic modulus G" and storage elastic modulus G' is a value G"/G' obtained by dividing loss elastic modulus G" by storage elastic modulus G', and represents a ratio of viscosity to elasticity. In general, the storage elastic modulus G' and loss elastic modulus G" of highly fusible resin, such as binder resin of a toner, are highly dependent on temperature. In the invention, therefore, measurements of storage elastic modulus G' and loss elastic modulus G" are made by vibrating a kneaded product in a molten state while changing the temperature under conditions that the frequency (1.0 Hz) and the strain (5%) are kept constant. By plotting these measurement results, the loss elastic modulus-temperature characteristic curve showing the relationship between loss elastic modulus Gas and temperature and the loss tangent (tan δ)-temperature characteristic curve showing the relationship between loss tangent and temperature are obtained. From these plots, the loss elastic modulus G" values at 120° C. and 200° C., and the loss tangent (tan δ) at 200° C. are determined.

With respect to the temperature condition in the spinning step, it is appropriate that the spinning be carried out at a temperature of the order of 120° C. to 200° C. comparable with temperatures ranging from the softening temperature of binder resin in a toner to a temperature lower than the thermal decomposition temperature of the binder resin. Therefore, the values of storage elastic modulus G', loss elastic modulus G" and loss tangent (tan δ) in such a temperature range are determined.

The toner 1 is manufactured by undergoing the pulverizing step, and the procedure is shifted from Step S3 to Step s4. Thus, the manufacturing of toner 1 is completed.

The volume average particle size of the thus manufactured toner 1 is preferably 5 μm or more and 10 μm or less. When the volume average particle size of toner is smaller than 5 μm, each individual toner matrix particle cannot assume sufficient electrostatic charger and toner scattering during the developing operation and image fogging occur. When the volume average particle size of toner is larger than 10 μm, the toner layer of toner images formed by development becomes thick, which leads to a difficulty of making grainy feeling of the toner less noticeable. As to the particle size distribution of the toner, it is preferable that toner matrix particles having sizes in the range of 5 μm or more and 10 m or less are present in a higher proportion. However, the toner can be used even when it has particle size distribution obtainable by a general pulverization method.

The thus manufactured toner matrix particles may be mixed with external additives capable of playing various functions, such as improvements in flowability of powder and triboelectrification, betterments of heat resistance, long-term storage stability and cleaning property, and control on an abrasion property of a photoreceptor surface. Examples of such external additives include fine powder of silica, fine powder of titanium oxide and fine powder of alumina. These external additives may be used each alone, or two or more of them may be used in combination. The suitable amount of external additives added is 0.1 part by weight or more and 10 parts by weight or less based on 100 parts by weight of toner matrix particles in consideration of the amount of electrostatic charge required for toner, effect of external additive addition upon abrasion of the photoreceptor surface, an ecological property of a toner, and so on.

The toner of the invention can be used, e.g., in development of electrostatic images when image formation is performed by electrophotography or an electrostatic recording method, or in development of magnetic latent images when image formation is performed by a magnetic recording method. In addition, the toner of the invention can be used as one-component developer as it is, and can also be used as two-component developer in which the toner and a carrier are mixed.

As the carrier, particles having magnetic properties can be used. Examples of particles having magnetic properties include a metal such as iron, ferrite, or magnetite, and an alloy of the metal and another metal such as aluminum or lead. Of these materials, ferrite is preferred over the others.

Alternatively, resin-coated carriers prepared by coating magnetic particles with resin, resin-dispersed carriers prepared by dispersing magnetic particles into resin, or the like may be used as a carrier. The resin with which magnetic particles are coated is not limited to particular one, and examples thereof include olefin resins, styrene resins, styrene/acrylic, resins, silicone resins, ester resins and fluorine-containing polymer resins. And the resin used for resin-dispersed carrier is not limited to particular one either. Examples thereof include styrene/acrylic resins, polyester resins, fluoropolymer resins and phenol resins. The carrier is preferably spherical or flat in shape.

The carrier has no particular limitation as to the volume average particle size. Considering enhancement of image quality, however, the volume average particle size of carrier is preferably 10 μm or more and 100 μm or less, more preferably 20 μm or mnore and 50 μm or less. In addition, the resistivity of carrier is preferably $10^8$ Ω·cm or above, more preferably $10^{12}$ Ω·cm or above. The carrier's resistivity is a value obtained by reading the current value under application of a voltage that, when a load of 1 kg/cm$^2$ is imposed on the carrier put in a vessel having a cross-sectional area of 0.50 cm$^2$ and crammed in the vessel by tapping, generates an electric field of 1,000 V/cm between the load and a bottom electrode. The low resistivity causes injection of charge into carrier when a developing bias voltage is applied to the developing roller, and thereby adhesion of carrier particles to a photoreceptor becomes ease. In addition, breakdown of the bias voltage tends to occur.

The magnetization intensity (maximum magnetization) of a carrier used is preferably 10 emu/g or more and 60 emu/g or less, more preferably 15 emu/g or more and 40 emu/g or less. Depending on the magnetic flux density of a developing roller used, the carrier having magnetization intensity lower than 10 emu/g is free from magnetic constraints under magnetic flux density conditions of commonly used developing rollers, so there is a risk of carrier scattering. On the other hand, when the magnetization intensity is increased beyond 60 emu/g, brush of the carrier grows to excessive height, with the result that the carrier becomes difficult to keep a state of non-contact with a latent image bearing member in the case of non-contact development, while in the case of contact development there is a risk that sweeping patterns tend to appear in the toner image obtained.

The usage ratio between the toner and the carrier in a two-component developer has no particular limitations, and it can be chosen properly according to the kinds of toner and carrier used. Taking a ferrite carrier as an example, however, it is appropriate that the toner be used in a proportion of 2% by weight or more and 30% by weight or less, preferably 2% by weight or more and 20% by weight or less, with respect to the total weight of the developer. In addition, the coverage of the carrier with the toner in the case of a two-component developer is preferably 40% by weight or more and 80% by weight or less.

As mentioned above, the two-component developer of the invention includes the toner of the invention of which toner matrix particles are excellent in surface smoothness and which is stabilized in properties such as flowability and chargeability, and a carrier, so it causes no degradation in image quality by ageing of toner's flowability and chargeability during the long-term use and can form high-quality images of high definition and high resolution.

Figure 7:
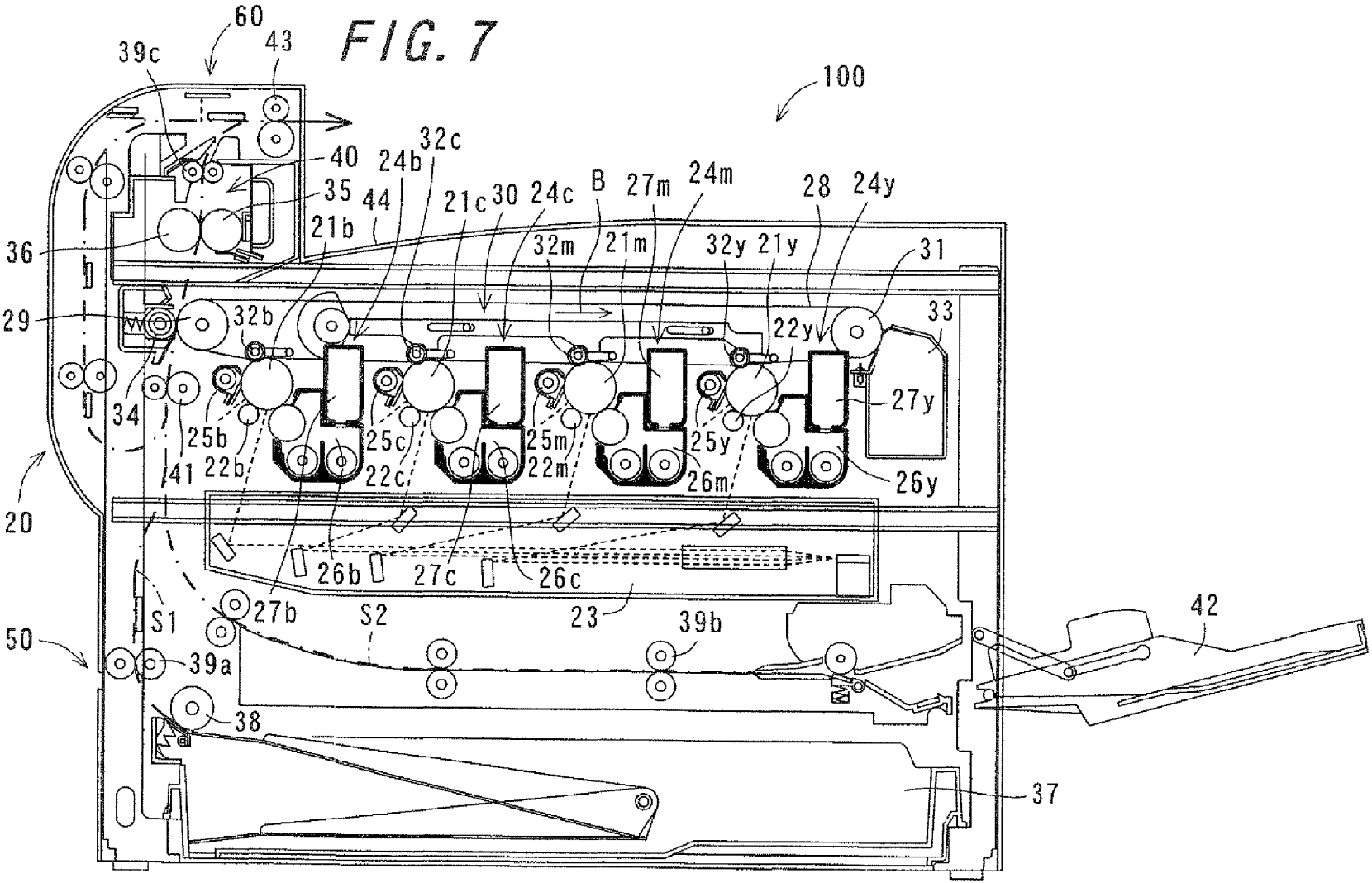
FIG. 7 is a sectional view schematically showing one example of constitution of image forming apparatus in which the toner of the invention is suitably used.

FIG. 7 is a sectional view schematically showing one example of constitution of image forming apparatus 100 in which the toner of the invention is suitably used. The image forming apparatus 100 is a multifunction printer having a copier function, a printer function, and a facsimile function together, and according to image information being conveyed to the image forming apparatus 1, a full-color or monochrome image is formed on a recording medium. That is, the image forming apparatus 100 has three types of printer mode, i.e., a copier mode, a printer mode and a FAX mode, and the printer mode is selected by a control unit (not shown) in accordance with, for example, the operation input from an operation portion (not shown) and reception of the printing job from an external equipment such as a personal computer, a mobile device, an information recording storage medium, and a memory device. The image forming apparatus 100 includes a toner image forming section 20, a transferring section 30, a fixing section 40, a recording medium feeding section 50, and a discharge section 60. In accordance with image information of respective colors of black (b), cyan (c), magenta (m), and yellow (y) which are contained in color image information, there are provided respectively four sets of the components constituting the toner image forming section 20 and some parts of the components contained in the transferring section 30. The tour sets of respective components provided for the respective colors are distinguished herein by giving alphabets indicating the respective colors to the end of the reference numerals, and in the case where the sets are collectively referred to, only the reference numerals are shown.

The toner image forming section 20 includes a photoreceptor drum 21, a charging section 22, an exposure unit 23, a developing device 24, and a cleaning unit 25. The charging section 22, the developing device 24, and the cleaning unit 25 are disposed around the photoreceptor drum 21 in the order just stated. The charging section 22 is disposed vertically below the developing section 24 and the cleaning unit 25.

The photoreceptor drum 21 is a latent image bearing member which is rotatably supported around an axis thereof by a drive mechanism (not shown) and includes a conductive substrate and a photosensitive layer formed on a surface of the conductive substrate (not shown). The conductive substrate may be formed into various shapes such as a cylindrical shape, a circular columnar shape, and a thin film sheet shape. Among these shapes, the cylindrical shape is preferred. The conductive substrate is formed of a conductive material. As the conductive material, those customarily used in the relevant field can be used including, for example, metals such as aluminum, copper, brass, zinc, nickel, stainless steel, chromium, molybdenum, vanadium, indium, titanium, gold, and platinum; alloys formed of two or more of the metals; a conductive film in which a conductive layer containing one or two or more of aluminum, aluminum alloy, tin oxide, gold, indium oxide, etc. is formed on a film-like substrate such as a synthetic resin film, a metal film, and paper; and a resin composition containing at least conductive particles or conductive polymers. As the film-like substrate used for the conductive film, a synthetic resin film is preferred and a polyester film is particularly preferred. Further, as the method of forming the conductive layer in the conductive film, vapor deposition, coating, etc. are preferred.

The photosensitive layer is formed, for example, by stacking a charge generating layer containing a charge generating substance, and a charge transporting layer containing a charge transporting substance. In this case, an undercoat layer is preferably formed between the conductive substrate and the charge generating layer or the charge transporting layer. When the undercoat layer is provided, the flaws and irregularities present on the surface of the conductive substrate are covered, leading to advantages such that the photosensitive layer has a smooth surface, that chargeability of the photosensitive layer can be prevented from degrading during repetitive use, and that the charging property of the photosensitive layer can be enhanced under at least either a low temperature circumstance or a low humidity circumstance. Further, the photosensitive layer may be a laminated photoreceptor having a highly-durable three-layer structure in which a photoreceptor surface-protecting layer is provided on the top layer.

The charge generating layer contains as a main ingredient a charge generating substance that generates charges under irradiation of light, and optionally contains known binder resin, plasticizer, sensitizer, etc. As the charge generating substance, materials used customarily in the relevant field can be used including, for example, perylene pigments such as perylene imide and perylenic acid anhydride; polycyclic quinone pigments such as quinacridone and anthraquinone; phthalocyanine pigments such as metal and non-metal phthalocyanines, and halogenated non-metal phthalocyanines; squalium dyes; azulenium dyes; thiapylirium dyes; and azo pigments having carbazole skeleton, styrylstilbene skeleton, triphenylamine skeleton, dibenzothiophene skeleton, oxadiazole skeleton, fluorenone skeleton, bisstilbene skeleton, distyryloxadiazole skeleton, or distyryl carbazole skeleton. Among those charge generating substances, non-metal phthalocyanine pigments, oxotitanyl phthalocyanine pigments, bisazo pigments containing fluorene rings and/or fluorenone rings, bisazo pigments containing aromatic amines, and trisazo pigments have high charge generating ability and are suitable for forming a highly-sensitive photosensitive layer. The charge generating substances may be used each alone, or two or more of them may be used in combination. The content of the charge generating substance is not particularly limited, and preferably from 5 parts by weight to 500 parts by weight and more preferably from 10 parts by weight to 200 parts by weight based on 100 parts by weight of the binder resin in the charge generating layer. Also as the binder resin for charge generating layer, materials used customarily in the relevant field can be used including, for example, melamine resin, epoxy resin, silicone resin, polyurethane, acrylic resin, vinyl chloride-vinyl acetate copolymer resin, polycarbonate, phenoxy resins polyvinyl butyral, polyallylate, polyamide, and polyester. The binder resins may be used each alone or, optionally, two or more of them may be used in combination.

The charge generating layer can be formed by dissolving or dispersing an appropriate amount of a charge generating substance, binder resin and, optionally, a plasticizer, a sensitizer, etc. respectively in an appropriate organic solvent which is capable of dissolving or dispersing the ingredients described above, to thereby prepare a coating solution for charge generating layer, and then applying the coating solution for charge generating layer to the surface of the conductive substrate, followed by drying. The thickness of the charge generating layer obtained in this way is not particularly limited, and preferably from 0.05 μm to 5 μm and more preferably from 0.1 μm to 2.5 μm.

The charge transporting layer stacked over the charge generating layer contains as essential ingredients a charge transporting substance having an ability of receiving and transporting charges generated from the charge generating substance, and binder resin for charge transporting layer, and optionally contains known antioxidant, plasticizer, sensitizer, lubricant, etc. As the charge transporting substance, materials used customarily in the relevant field can be used includi for example: electron donating materials such as poly-N-vinyl carbazole, a derivative thereof, poly-γ-carbazolyl ethyl glutamate, a derivative thereof, a pyrene-formaldehyde condensation product, a derivative thereof, polyvinylpyrene, polyvinyl phenanthrene, an oxazole derivative, an oxadiazole derivative, an imidazole derivative, 9-(p-diethylaminostyryl) anthracene, 1,1-bis(4-dibenzylaminophenyl)propane, styrylanthracene, styrylpyrazoline, a pyrazoline derivative, phenyl hydrazones, a hydrazone derivative, a triphenylamine compound, a tetraphenyldiamine compound, a triphenylmethane compound, a stilbene compound, and an azine compound having 3-methyl-2-benzothiazoline ring; and electron accepting materials such as a fluorenone derivative, a dibenzothiophene derivative, an indenothiophene derivative, a phenanthrenequinone derivative, an indenopyridine derivative, a thioquisantone derivative, a benzo[c]cinnoline derivative, a phenazine oxide derivative, tetracyanoethylene, tetracyanoquinodimethane, bromanil, chloranil, and benzoquinone. The charge transporting substances may be used each alone, or two or more of them may be used in combination. The content of the charge transporting substance is not particularly limited, and preferably from 10 parts by weight to 300 parts by weight and more preferably from 30 parts by weight to 150 parts by weight based on 100 parts by weight of the binder resin in the charge transporting layer. As the binder resin for charge transporting layer, it is possible to use materials which are used customarily in the relevant field and capable of uniformly dispersing the charge transporting substance, including, for example, polycarbonate, polyallylate, polyvinylbutyral, polyamide, polyester, polyketone, epoxy resin, polyurethane, polyvinylketone, polystyrene, polyacrylamide, phenolic resin, phenoxy resin, polysulfone resin, and copolymer resin thereof. Among those materials, in view of the film forming property, and the wear resistance, an electrical property etc. of the obtained charge transporting layer, it is preferable to use, for example, polycarbonate which contains bisphenol Z as the monomer ingredient (hereinafter referred to as "bisphenol Z polycarbonate"), and a mixture of bisphenol Z polycarbonate and other polycarbonate. The binder resins may be used each alone, or two or more of them may be used in combination.

The charge transporting layer preferably contains an antioxidant together with the charge transporting substance and the binder resin for charge transporting layer. Also for the antioxidant, materials used customarily in the relevant field can be used including, for example, Vitamin E, hydroquinone, hindered amine, hindered phenol, paraphenylene diamine, arylalkane and derivatives thereof, an organic sulfur compound, and an organic phosphorus compound. The antioxidants may be used each alone, or two or more of them may be used in combination. The content of the antioxidant is not particularly limited, and is 0.01% by weight to 10% by weight and preferably 0.05% by weight to 5% by weight of the total amount of the ingredients constituting the charge transporting layer. The charge transporting layer can be formed by dissolving or dispersing an appropriate amount of a charge transporting substance, binder resin and, optionally, an antioxidant, a plasticizer, a sensitizer, etc. respectively in an appropriate organic solvent which is capable of dissolving or dispersing the ingredients described above, to thereby prepare a coating solution for charge transporting layer, and applying the coating solution for charge transporting layer to the surface of a charge generating layer followed by drying. The thickness of the charge transporting layer obtained in this way is not particularly limited, and preferably 10 μm to 50 μm and more preferably 15 μm to 40 μm. Note that it is also possible to form a photosensitive layer in which a charge generating substance and a charge transporting substance are present in one layer. In this case, the kind and content of the charge generating substance and the charge transporting substance, the kind of the binder resin, and other additives may be the same as those in the case of forming separately the charge generating layer and the charge transporting layer.

In the embodiment, there is used a photoreceptor drum which has an organic photosensitive layer as described above containing the charge generating substance and the charge transporting substance. It is, however, also possible to use, instead of the above photoreceptor drums a photoreceptor drum which has an inorganic photosensitive layer containing silicon or the like.

The charging section 22 faces the photoreceptor drum 21 and is disposed away from the surface of the photoreceptor drum 21 when viewed in a longitudinal direction of the photoreceptor drum 21. The charging section 22 charges the surface of the photoreceptor drum 21 so that the surface of the photoreceptor drum 21 has predetermined polarity and potential. As the charging section 22, it is possible to use a charging brush type charging device, a charger type charging device, a pin array type charging device, an ion-generating device, etc. Although the charging section 22 is disposed away from the surface of the photoreceptor drum 21 in the embodiment, the configuration is not limited thereto. For example, a charging roller may be used as the charging section 22, and the charging roller may be disposed in pressure-contact with the photoreceptor drum 21. It is also possible to use a contact-charging type charger such as a charging brush or a magnetic brush.

The exposure unit 23 is disposed so that light beams corresponding to each color information emitted from the exposure unit 23 passes between the charging section 22 and the developing section 24 and reaches the surface of the photoreceptor drum 21. In the exposure unit 23, the image information is converted into light beams corresponding to each color information of black (b), cyan (c), magenta (m), and yellow (y), and the surface of the photoreceptor drum 21 which has been evenly charged by the charging section 22, is exposed to the light beams corresponding to each color information to thereby form electrostatic latent images on the surfaces of the photoreceptor drums 21. As the exposure unit 23, it is possible to use a laser scanning unit having a laser-emitting portion and a plurality of reflecting mirrors. The other usable examples of the exposure unit 23 may include an LED array and a unit in which a liquid-crystal shutter and a light source are appropriately combined with each other.

Figure 8:
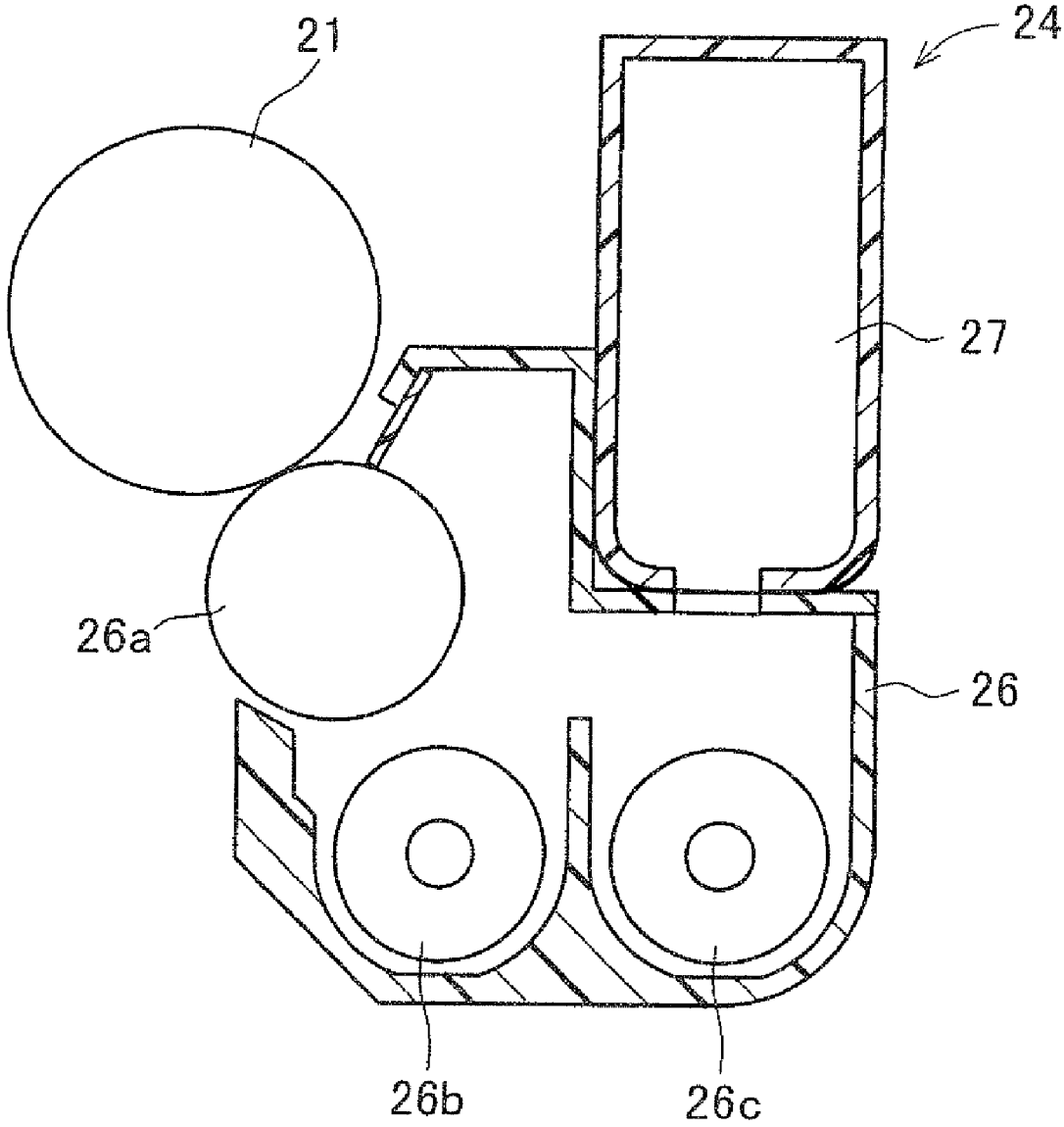
FIG. 8 is a sectional view schematically showing constitution of a developing device in which the toner of the invention is suitably used.

FIG. 8 is a sectional view schematically showing constitution of the developing device 24 in which the toner of the invention is suitably used. The developing section 24 includes a developing tank 26 and a toner hopper 27. The developing tank 26 is a container-shaped member which is disposed so as to face the surface of the photoreceptor drum 21 and used to supply a toner to an electrostatic latent image formed on the surface of the photoreceptor drum 21 so as to develop the electrostatic latent image into a visualized image, i.e. a toner image. The developing tank 26 contains in an internal space thereof the toner, and rotatably supports roller members such as a developing roller 26*a*, a supplying roller 26*b*, and an agitating roller 26*c*, or screw members, which roller or screw members are contained in the developing tank 26. The developing tank 26 has an opening in a side face thereof opposed to the photoreceptor drum 21. The developing roller 26*a* is rotatably provided at such a position as to face the photoreceptor drum 21 through the opening just stated. The developing roller 26*a* is a roller-shaped member for supplying a toner to the electrostatic latent image on the surface of the photoreceptor drum 21 in a pressure-contact portion or most-adjacent portion between the developing roller 26*a* and the photoreceptor drum 21. In supplying the toner, to a surface of the developing roller 26*a* is applied potential whose polarity is opposite to polarity of the potential of the charged toner, which serves as development bias voltage. By so doing, the toner on the surface of the developing roller 26*a* is smoothly supplied to the electrostatic latent image. Furthermore, an amount of the toner being supplied to the electrostatic latent image (which amount is referred to as "toner attachment amount") can be controlled by changing a value of the development bias voltage. The supplying roller 26*b* is a roller-shaped member which is rotatably disposed so as to face the developing roller 26*a* and used to supply the toner to the vicinity of the developing roller 26*a*. The agitating roller 26*c* is a roller-shaped member which is rotatably disposed so as to face the supplying roller 26*b* and used to feed to the vicinity of the supplying roller 26*b* the toner which is newly supplied from the toner hopper 27 into the developing tank 26. The toner hopper 27 is disposed so as to communicate a toner replenishment port (not shown) formed in a vertically lower part of the toner hopper 27, with a toner reception port (not shown) formed in a vertically upper part of the developing tank 26. The toner hopper 27 replenishes the developing tank 26 with the toner according to toner consumption. Further, it may be possible to adopt such configuration that the developing tank 26 is replenished with the toner supplied directly from a toner cartridge of each color without using the toner hopper 27.

The cleaning unit 25 removes the toner which remains on the surface of the photoreceptor drum 21 after the toner image has been transferred to the recording medium, and thus cleans the surface of the photoreceptor drum 21. In the cleaning unit 25, a platy member is used such as a cleaning blade. In the image forming apparatus of the invention, an organic photoreceptor drum is mainly used as the photoreceptor drum 21. A surface of the organic photoreceptor drum contains a resin component as a main ingredient and therefore tends to be degraded by chemical action of ozone which is generated by corona discharging of the charging section 22. The degraded surface part is, however, worn away by abrasion through the cleaning unit 25 and thus removed reliably, though gradually. Accordingly, the problem of the surface-degradation caused by the ozone, etc. is actually solved, and it is thus possible to stably maintain the potential of charges given by the charging operation over a long period of time. Although the cleaning unit 25 is provided in the embodiment, no limitation is imposed on the configuration and the cleaning unit 25 does not have to be provided.

In the toner image forming section 20*r* signal light corresponding to the image information is emitted from the exposure unit 23 to the surface of the photoreceptor drum 11 which has been evenly charged by the charging section 22, thereby forming an electrostatic latent image; the toner is then supplied from the developing section 24 to the electrostatic latent image, thereby forming a toner image, the toner image is transferred to an intermediate transfer belt 28; and the toner which remains on the surface of the photoreceptor drum 21 is removed by the cleaning unit 25. A series of toner image forming operations just described are repeatedly carried out.

The transferring section 30 is disposed above the photoreceptor drum 21 and includes the intermediate transfer belt 28, a driving roller 29*r* a driven roller 31, an intermediate transferring roller 32*b*, 32*c*, 32*m*, 32*y*, a transfer belt cleaning unit 33, and a transferring roller 34. The intermediate transfer belt 28 is an endless belt stretched between the driving roller 29 and the driven roller 31, thereby forming a loop-shaped travel path. The intermediate transfer belt 28 rotates in an arrow B direction, that is, a direction in which a surface of intermediate transfer belt 28 in contact with the photoreceptor drum 21 moves from the photoreceptor drum 21*y* to the photoreceptor drum 21*b*.

When the intermediate transfer belt 28 passes by the photoreceptor drum 21 in contact therewith, the transfer bias voltage whose polarity is opposite to the polarity of the charged toner on the surface of the photoreceptor drum 21 is applied from the intermediate transferring roller 32 which is disposed opposite to the photoreceptor drum 21 across the intermediate transfer belt 28, with the result that the toner image formed on the surface of the photoreceptor drum 21 is transferred onto the intermediate transfer belt 28. In the case of a multicolor image, the toner images of respective colors formed on the respective photoreceptor drums 21*y*, 21*m*, 21*c*, and 21*b* are sequentially transferred and overlaid onto the intermediate transfer belt 28, thus forming a multicolor toner image. The driving roller 29 can rotate around an axis thereof with the aid of a drive mechanism (not shown), and the rotation of the driving roller 29 drives the intermediate transfer belt 28 to rotate in the arrow R direction. The driven roller 31 can be driven to rotate by the rotation of the driving roller 29, and imparts constant tension to the intermediate transfer belt 28 so that the intermediate transfer belt 28 does not go slack. The intermediate transferring roller 32 is disposed in pressure-contact with the photoreceptor drum 21 across the intermediate transfer belt 29, and capable of rotating around its own axis by a drive mechanism (not shown). The intermediate transferring roller 32 is connected to a power source (not shown) for applying the transfer bias as described above, and has a function of transferring the toner image formed on the surface of the photoreceptor drum 21 to the intermediate transfer belt 28. The transfer belt cleaning unit 33 is disposed opposite to the driven roller 31 across the intermediate transfer belt 28 so as to come into contact with an outer circumferential surface of the intermediate transfer belt 28. When the intermediate transfer belt 28 contacts the photoreceptor drum 21, the toner is attached to the intermediate transfer belt 28, some of which toner will not be transferred to a recording medium and remain on the intermediate transfer belt 28. Since the residual toner may cause contamination on a reverse side of the recording medium, the transfer belt cleaning unit 33 removes and collects the toner on the surface of the intermediate transfer belt 28. The transferring roller 34 is disposed in pressure-contact with the driving roller 29 across the intermediate transfer belt 28, and capable of rotating around its own axis by a drive mechanism (not shown). In a pressure-contact portion (a transfer nip portion) between the transferring roller 34 and the driving roller 29, a toner image which has been carried by the intermediate transfer belt 28 and thereby conveyed to the pressure-contact portion is transferred onto a recording medium fed from the later-described recording medium feeding section 50. The recording medium carrying the toner image is fed to the fixing section 40. In the transferring section 30, the toner image is transferred from the photoreceptor drum 21 onto the intermediate transfer belt 28 in the pressure-contact portion between the photoreceptor drum 21 and the intermediate transferring roller 28, and by the intermediate transfer belt 28 rotating in the arrow B direction, the transferred toner image is conveyed to the transfer nip portion where the toner image is transferred onto the recording medium.

The fixing section 40 is provided downstream of the transferring section 30 along a conveyance direction of the recording medium, and contains a fixing roller 35 and a pressure roller 36. The fixing roller 35 can rotate by a drive mechanism (not shown), and heats the toner constituting an unfixed toner image carried on the recording medium so that the toner is fused to be fixed on the recording medium. Inside the fixing roller 35 is provided a heating portion (not shown). The heating portion heats the heating roller 35 so that a surface of the heating roller 35 has a predetermined temperature (heating temperature). For the heating portion, a heater, a halogen lamp, and the like device can be used, for example. The heating-portion is controlled by the later-described fixing condition controlling portion. In the vicinity of the surface of the fixing roller 35 is provided a temperature detecting sensor which detects a surface temperature of the fixing roller 35. A result detected by the temperature detecting sensor is written to a memory portion of the later-described control unit. On the basis of the detected result written to the memory portion, the fixing condition controlling portion controls the operation of the heating portion. The pressure roller 36 is disposed in pressure-contact with the fixing roller 35, and supported so as to be rotatably driven by the rotation of the fixing roller 35. The pressure roller 36 helps the toner image to be fixed onto the recording medium by pressing the toner and the recording medium when the toner is fused to be fixed on the recording medium by the fixing roller 35. A pressure-contact portion between the fixing roller 35 and the pressure roller 36 is a fixing nip portion. In the fixing section 40, the recording medium onto which the toner image has been transferred in the transfer section 30 is nipped by the fixing roller 35 and the pressure roller 36 so that when the recording medium passes through the fixing nip portion, the toner mage is pressed and thereby fixed onto the recording medium under heat, whereby a toner image is formed.

The recording medium feeding section 50 includes an automatic paper feed tray 37, a pickup roller 38, conveying rollers 39*a* and 39*b*, registration rollers 41, and a manual paper feed tray 42. The automatic paper feed tray 37 is disposed in a vertically lower part of the image forming apparatus 100 and in form of a container-shaped member for storing the recording mediums Examples of the recording medium include plain paper, color copy paper, sheets for overhead projector, and postcards. The pickup roller 38 takes out sheet by sheet the recording mediums stored in the automatic paper feed tray 37, and feeds the recording mediums to a paper conveyance path S1. The conveying rollers 39*a* are a pair of roller members disposed in pressure-contact with each other, and conveys the recording medium to the registration rollers 41. The registration rollers 41 are a pair of roller members disposed in pressure-contact with each other, and feeds to the transfer nip portion the recording medium fed from the conveying rollers 39*a* in synchronization with the conveyance of the toner image carried on the intermediate transfer belt 28 to the transfer nip portion. The manual paper feed tray 42 is a device Storing recording mediums which are different from the recording mediums stored in the automatic paper feed tray 37 and may have any size and which are to be taken into the image forming apparatus. The recording medium taken in from the manual paper feed tray 42 passes through a paper conveyance path S2 by use of the conveying rollers 39*b*, thereby being fed to the registration rollers 41. In the recording medium feeding section 50, the recording medium supplied sheet by sheet from the automatic paper feed tray 37 or the manual paper feed tray 42 is fed to the transfer nip portion in synchronization with the conveyance of the toner image carried on the intermediate transfer belt 28 to the transfer nip portion.

The discharging section 60 includes the conveying rollers 39*c*, discharging rollers 43, and a catch tray 44. The conveying rollers 39*c* are disposed downstream of the fixing nip portion along the paper conveyance direction, and conveys toward the discharging rollers 43 the recording medium onto which the image has been fixed by the fixing section 40. The discharging rollers 43 discharge the recording medium onto which the image has been fixed, to the catch tray 44 disposed on a vertically upper surface of the image forming apparatus 100. The catch tray 44 stores the recording medium onto which the image has been fixed.

The image forming apparatus 100 includes a control unit (not shown). The control unit is disposed, for example, in an upper part of an internal space of the image forming apparatus 100, and contains a memory portion, a computing portion, and a control portion. To the memory portion of the control unit are input, for example, various set values obtained by way of an operation panel (not shown) disposed on the upper surface of the image forming apparatus 100, results detected from a sensor (not shown) etc. disposed in various portions inside the image forming apparatus 100, and image information obtained from an external equipment. Further, programs for operating various functional elements are written. Examples of the various functional elements include a recording medium determining portion, an attachment amount controlling portion, and a fixing condition controlling portion. For the memory portion, those customarily used in the relevant filed can be used including, for example, a read only memory (ROM), a random access memory (PAM), and a hard disc drive (HDD). For the external equipment, it is possible to use electrical and electronic devices which can form or obtain the image information and which can be electrically connected to the image forming apparatus 100. Examples of the external equipment include a computer, a digital camera, a television, a video recorder, a DVD (digital versatile disc) recorder, an HDDVD (high-definition digital versatile disc), a blu-ray disc recorder, a facsimile machine, and a mobile computer. The computing portion of the control unit takes out the various data (such as an image formation order, the detected result, and the image information) written in the memory portion and the programs for various functional elements, and then makes various determinations. The control portion of the control unit sends to a relevant device a control signal in accordance with the result determined by the computing portion, thus performing control on operations. The control portion and the computing portion include a processing circuit which is achieved by a microcomputer, a microprocessor, etc. having a central processing unit. The control unit contains a main power source as well as the above-stated processing circuit. The power source supplies electricity to not only the control unit but also respective devices provided inside the image forming apparatus 100.

As described above, an image is developed by the developing device 24 of the invention with use of the toner of the invention, in which toner the toner matrix particles 2 are excellent in surface smoothness and which toner is highly stable in properties such as flowability and chargeability, with the result that a high-definition and high-resolution toner image can be formed on the photoreceptor drum 21. Accordingly, in the image forming apparatus 100 of the invention, the flowability, chargeability, etc. of the toner are not changing in course of time even during a long-term use owing to the developing device 24 of the invention provided in the image forming apparatus 100, so that image quality is prevented from degrading, thus allowing for a high-quality image with high definition and resolution.

EXAMPLES

Hereinafter, the invention will be specifically explained with reference to Examples and Comparative examples to which the invention is not particularly limited within its scope.

[Method of Measuring Values of Properties]

Values of properties in Examples and Comparative examples are measured as follows.

[Glass Transition Temperature (Tg)]

Using a differential scanning calorimeter; DIAMOND DSC (trade name) manufactured by PerkinElmer Japan Co., Ltd., 0.01 g of a sample was heated at a temperature of which increase rate was 10° C./min based on Japanese Industrial Standards (JIS) K7121-1987, thus obtaining a DSC curve. A straight line was drawn toward a high-temperature side extendedly from a base line on the low-temperature side of an endothermic peak corresponding to glass transition of the DSC curve which had been obtained as above A tangent line was also drawn at a point where a gradient thereof was maximum against a curve on lower-temperature side of the peak. A temperature at an intersection of the straight line and the tangent line was determined as the glass transition temperature (Tg).

[Softening Temperature ($T_{1/2}$)]

Using a device for evaluating flow characteristics: FLOWTESTER CFT-500C (trade name) manufactured by Shimadzu Corporation, 1 g of a sample inserted into a cylinder was heated at a temperature of which increase rate was 6° C./min, under load of 10 kgf/cm$^2$ (0.98 MPa) so as to be pushed out of a die, and a temperature of the sample at the time when a half of the sample had flowed out of the die, was determined as the softening temperature ($T_{1/2}$). The die used had an aperture of 1 mm and a length of 1 mm).

<Peak-Top Molecular Weight and Molecular Weight Distribution Index (Mw/Mn)>

The molecular weight distribution curve of a sample was obtained by using a GPC system HLC-8220GPC (trade name) manufactured by TOSOH Corporation, and infusing into the system 200 μL of a sample solution prepared at 40° C. as a 0.25-wt % tetrahydrofuran (hereinafter abbreviated as THF) solution of a sample. The molecular weight at the top of the peak of the molecular weight distribution curve obtained was determined as the peak-top molecular weight. In addition, the weight average molecular weight Mw and the number average molecular weight Mn were determined from the Molecular weight distribution curve obtained. Further, the molecular weight distribution index which was a ratio of the weight average molecular weight Mw to the number average molecular weight Mn (a Mw/Mn ratio, which may be hereinafter simply denoted as Mw/Mn) was calculated. Incidentally, a calibration curve for the molecular weight was prepared by use of standard polystyrene.

<Acid Value>

The acid value of a sample was measured as follows in accordance with a neutralization titration method. A sample in an amount of 5 g was dissolved in 50 mL of THF, thereto was added several drops of an ethanol solution of phenolphthalein as an indicator, and then the resultant sample was subjected to titration with a 0.1 mol/L aqueous solution of potassium hydroxide (KOH). The point at which the sample solution underwent a change in color from colorless to magenta is defined as endpoint, and the acid value (mg KOH/g) of the sample was calculated from the amount of the aqueous solution of potassium hydroxide taken to reach the endpoint and the amount of sample used for the titration.

<THF-Insoluble Portion>

A sample in an amount of 1 g was put in a filter paper thimble, mounted in a Soxhlet extractor, and heated under reflux for 6 hours by use of 100 mL of THF as solvent, thereby extracting a soluble component in the sample with THF. After removal of the solvent from the extract solution containing the extracted THF soluble component, the THF-soluble component was dried at 100° C. for 24 hours. The weight X (g) of the thus obtained THF-soluble component was weighed. From the weight X (g) of the THF-soluble component determined and the weight (1 g) of the sample used for the measurement, the proportion P (wt %) of the THF-insoluble portion, which was the THF-insoluble component in a sample binder resin, was calculated on the basis of the following expression (2). Hereinafter, the proportion P is referred to as THF-insoluble portion.

$$P(\text{wt }\%)=\{1(\text{g})-X(\text{g})\}/1(\text{g})\times 100 \quad (2)$$

<Melting Temperature (Tm)>

In conformance with Japanese Industrial Standards (JIS) K7121-1987 and by use of a differential scanning calorimeter; DIAMOND DSC (trade name) manufactured by PerkinElmer Japan Co., Ltd., a DSC curve is taken through operations that 0.01 g of a sample was heated up to 200° C. from 20° C. at a temperature increase rate of 10° C./min, then cooled down to 20° C. from 200° C. at a temperature decrease rate of 50° C./min, and further heated up to 200° C. from 20° C. at a temperature increase rate of 10° C./min. The temperature at the top of the melting heat peak of the DSC curve was defined as the melting temperature (Tm).

<Fiber Diameter>

A fibrous kneaded product was photographed with an electron microscope. VE-9500 (trade name) manufactured by KEYENCE CORPORATION, set at a magnification of 1,000. From the electron micrograph thus taken, 100 measuring points were randomly selected. Diameter measurements were made on the fibers observed at these points, and the mean value and the coefficient of variation of the thus measured fiber diameters were calculated.

<Storage Elastic Modulus G' and Loss Elastic Modulus G">

Storage elastic modulus G' and loss elastic modulus C" measurements with a stress rheometer (manufactured by REOLOGICA Instruments AB) were made using a parallel plate in the following manner. A sample in an amount of 0.6 g was pressed for 1 minute at room temperature (25° C.) under about 20 MPa by use of a tablet forming machine and made into a measuring sample having a thickness of about 0.5 mm and a diameter of 25 mm. This measuring sample was inserted into a parallel plate having a diameter of 25 mm, and molten by heating. Then, the spacing of the parallel plate was set at 1.0 mm, and sine-wave vibrations were created in the measuring sample by applying to the sample a strain sinusoidally oscillating in the circumferential direction of the parallel plate under conditions of strain of 5% and frequency of 1.0 Hz. And at the same time, the temperature of the measuring sample was raised to 200° C. from 80° C. at a temperature increase rate of 3° C./min. Under these conditions, measurements of storage elastic modulus G' and loss elastic modulus G" were made on the measuring sample at each of the temperatures set in 10° C. intervals. From the measurement results obtained, a loss elastic modulus-temperature characteristic curve showing the relationship between loss elastic modulus G" and temperature and a loss tangent-temperature characteristic curve showing the relationship between loss tangent (tan δ, G"/G') and temperature were plotted. From these plots, the loss elastic modulus G" values at 120° C. and 200° C. and the loss tangent (tan δ) at 200° C. were determined.

Example 1

<Kneading Step>

Toner raw materials including 90.5 wt % (100 parts by weight) of polyester resin (used as binder resin, glass transition temperature (Tg): 60° C. softening temperature ($T_{1/2}$): 110° C., peak-top molecular weight: 12,500, Mw/Mn=5.2, acid value=16, THF-insoluble portion: 0%), 5.0 wt % (5.5 parts by weight) of KET. BLUE 111 (used as colorant, trade name: Copper Phthalocyanine 15:3, manufactured by Clariant Corporation), 3.0 wt % (3.3 parts by weight) of paraffin wax (used as release agent, trade name: HNP-10, manufactured by Nippon Seiro Co., Ltd., melting temperature (Tm): 75° C.) and 1.5 wt % (1.7 parts by weight) of a charge control agent (trade name: Copy Charge N4P VP2481, manufactured by Clariant (Japan) K.K.) were mixed for 3 minutes by means of a Henschel mixer (trade name: FM20C, manufactured by Mitsui Mining Co., Ltd.), thereby preparing a raw material mixture. A 20.0 kg portion of this raw material mixture was melt-kneaded by using a biaxial extruder under conditions that the set cylinder temperature was 110° C. and the number of barrel revolutions was 250 rpm, and then cooled down to room temperature. Thus, a kneaded product was prepared.

With respect to the thus obtained kneaded product, the value of its loss elastic modulus G" at 120° C. was found to be $5.2\times10^4$ Pa, the value of its loss elastic modulus G" at 200° C. was found to be $2.3\times10^2$ Pa, and the value of its loss tangent (tan δ) at 200° C. was found to be 5.3.

<Spinning Step>

As the discharge rate of a gear pump was controlled to create an extrusion pressure of 2.0 MPa, and further as a hot-air heater and a hot-air blower were controlled to ensure an outlet temperature of 150° C., the kneaded product prepared in the kneading step was fed into a spinning nozzle having nozzle orifices 190 μm in inside diameter and hot-air discharge outlets, and extruded from the nozzle orifices, together with the hot air discharged from the hot-air discharge outlets, and thereby made into a fibrous kneaded product. The fiber diameter of the thus obtained fibrous kneaded product was found to be 6.8 μm (coefficient of variation: 15).

<Pulverizing Step>

The fibrous kneaded product obtained in the spinning step was fed into a mechanical pulverizing machine with a built-in pulverizing rotor and a built-in classifying rotor, pulverized and classified under conditions that the number of revolutions of the pulverizing rotor was set at 9,500 rpm, the number of revolutions of the classifying rotor at 7,000 rpm and the airflow of the blower at 13 $Nm^3$/min, and thereto fine-particle silica was added as an external additive, followed by mixing by means of a Henschel mixer. Thus, 18.3 kg of a toner was produced. In the fine-particle silica used herein, 1 parts by weight of large particles having a volume average particle size of 100 nm and 1.5 parts by weight of small particles having a volume average particle size of 12 nm were included based on 100 parts by weight of toner matrix particles.

Example 2

A toner was produced in the same manner as in Example 1, except that the hot-air heater and the hot-air blower were controlled to ensure an outlet temperature of 140° C.

Example 3

A toner was produced in the same manner as in Example 1, except that a spinning nozzle having nozzle orifices 140 μm in inside diameter and hot-air discharge outlets was used.

Comparative Example 1

A toner was produced in the same manner as in Example 1, except that the hot-air heater and the hot-air blower were controlled to ensure an outlet temperature of 160° C. and a spinning nozzle having nozzle orifices 140 μm in inside diameter and hot-air discharge outlets was used.

Comparative Example 2

A toner was produced in the same manner as in Example 1, except that the discharge rate of the gear pump was controlled to create an extrusion pressure of 1.5 MPa and a spinning nozzle having nozzle orifices 140 μm in inside diameter and hot-air discharge outlets was used.

Comparative Example 3

A toner was produced in the same manner as in Example 1, except that polyester resin (glass transition temperature (Tg): 58° C., softening temperature ($T_{1/2}$) 102° C., peak-top molecular weight: 8,500, Mw/Mn=2.5, acid value=13, THF-insoluble portion: 0%) was used as the binder resin in the kneading step, the hot-air heater and the hot-air blower were controlled to ensure an outlet temperature of 120° C. in the spinning step and a spinning nozzle having nozzle orifices 140 μm in inside diameter and hot-air discharge outlets was used.

Comparative Example 4

A toner was produced in the same manner as in Example 1, except that a polyester resin (glass transition temperature (Tg): 60° C., softening temperature ($T_{1/2}$): 116° C., peak-top molecular weight: 32,100, Mw/Mn=8.2, acid value=9, THF-insoluble portion: 4%) was used as the binder resin in the kneading step and, in the spinning step, the discharge rate of the gear pump was controlled to create an extrusion pressure of 4.5 MPa, the hot-air heater and the hot-air blower were controlled to ensure an outlet temperature of 160° C. and a spinning nozzle having nozzle orifices 140 μm in inside diameter and hot-air discharge outlets was used.

Comparative Example 5

A toner was produced in the same manner as in Example 1, except that pulverization and classification in the pulverizing step were carried out under a condition that the number of revolutions of the classifying rotor was set at 8,200 rpm.

Comparative Example 6

A toner was produced in the same manner as in Example 1, except that the discharge rate of the gear pump was controlled to create an extrusion pressure of 3.5 MPa and a spinning nozzle having nozzle orifices 100 μm in inside diameter and hot-air discharge outlets was used.

Comparative Example 7

The kneaded product obtained in the kneading step of Example 1 was crushed into coarse particles having a volume average size of the order of 100 μm to 5 mm by means of a cutter mill: VM-16 (trade name) manufactured by Kabushiki Kaisha Orient. Thereafter, the coarse particles obtained were pulverized into fine particles of the desired particle size by means of a fluidized-bed jet pulverizer: COUNTER JET MILL (trade name) manufactured by Hosokawa Micron Corporation, and thereto fine-particle silica was added as an external additive, followed by mixing by means of a Henschel mixer. Thus, 18.3 kg of the toner was produced. In the fine-particle silica used herein, 1 part by weight of large particles having a volume average particle size of 100 nm and 1.5 parts by weight of small particles having a volume average particle size of 12 nm were included based on 100 parts by weight of toner matrix particles.

Table 1 provides a summary of the concentrations of the colorant added in the kneading step, various conditions (extrusion pressures, outlet temperatures and inside diameters of nozzle orifices) adopted in the spinning step and the physical properties (fiber diameters and viscoelasticity values) of the fibrous kneaded products made for toner production in Examples 1 to 3 and Comparative Examples 1 to 7. Incidentally, the values of loss elastic modulus G" and loss tangent (tan δ) of the fibrous kneaded products are the same as the values of loss elastic modulus G" and loss tangent (tan δ) of the kneaded products obtained in the kneading step, respectively.

Then, the particle size $d_{50}$ which was a particle size corresponding to a cumulative volume of 50% from the greater particle-size side in cumulative volume distribution was determined as follows.

To 50 ml of an electrolytic solution: ISOTON-II (trade name) manufactured by Beckman Coulter, Inc., 20 mg of a sample and 1 ml of sodium alkyl ether sulfate (a dispersant, manufactured by Kishida Chemical Co., Ltd.) were added.

TABLE 1

| | Kneading Step | Spinning Step | | | Fibrous Kneaded Product | | | | | |
|---|---|---|---|---|---|---|---|---|---|---|
| | | | | | Fiber Diameter | | Viscoelasticity | | | |
| | Colorant Concentration (wt %) | Extrusion Pressure (MPa) | Outlet Temperature (° C.) | Inside Diameter (μm) | Measured Value (μm) | Coefficient of Variation | G" (120° C., Pa) | G" (200° C., Pa) | G" (200° C., Pa) | tanδ (200° C.) |
| Example 1 | 5 | 2.0 | 150 | 190 | 6.8 | 15 | $5.2 \times 10^4$ | $2.3 \times 10^2$ | $4.3 \times 10^1$ | 5.3 |
| Example 2 | 5 | 2.0 | 140 | 190 | 9.5 | 17 | $5.2 \times 10^4$ | $2.3 \times 10^2$ | $4.3 \times 10^1$ | 5.3 |
| Example 3 | 5 | 2.0 | 150 | 140 | 5.3 | 14 | $5.2 \times 10^4$ | $2.3 \times 10^2$ | $4.3 \times 10^1$ | 5.3 |
| Comparative Example 1 | 5 | 2.0 | 160 | 140 | 4.5 | 32 | $5.2 \times 10^4$ | $2.3 \times 10^2$ | $4.3 \times 10^1$ | 5.3 |
| Comparative Example 2 | 5 | 1.5 | 150 | 140 | 10.5 | 18 | $5.2 \times 10^4$ | $2.3 \times 10^2$ | $4.3 \times 10^1$ | 5.3 |
| Comparative Example 3 | 5 | 2.0 | 120 | 140 | Wide distribution | | $4.5 \times 10^4$ | 9.7 | $5.3 \times 10^{-1}$ | 18.3 |
| Comparative Example 4 | 5 | 4.5 | 160 | 140 | Wide distribution | | $5.8 \times 10^5$ | $7.8 \times 10^2$ | $4.6 \times 10^2$ | 1.7 |
| Comparative Example 5 | 5 | 2.0 | 150 | 190 | 6.8 | 15 | $5.2 \times 10^4$ | $2.3 \times 10^2$ | $4.3 \times 10^1$ | 5.3 |
| Comparative Example 6 | 5 | 3.5 | 150 | 100 | 3.1 | 30 | $5.2 \times 10^4$ | $2.3 \times 10^2$ | $4.3 \times 10^1$ | 5.3 |
| Comparative Example 7 | 5 | — | — | — | — | — | — | — | — | — |

<Evaluations>

Evaluations of the aspect ratio, the surface smoothness ($d_B/d_{50}$, the number of reentrants), the state of the release agent, the embedability of the external additive, the electrostatic charge stability, the flowability and the yield were made on the toner produced in each of Examples 1 to 3 and Comparative Examples 1 to 7 in accordance with the following methods, respectively.

(Aspect Ratio)

Toner matrix particles were photographed with an electron microscope: VE-9500 (trade name) manufactured by KEYENCE CORPORATION, set at a magnification of 1,000. On the electron micrograph thus taken, 100 toner matrix particles were randomly selected, and diameters L and heights H thereof were determined. And the mean value of aspect ratios (H/L) was calculated. The aspect ratio was evaluated on the following criterion.

Good: The aspect ratio was 0.5 or higher and 5.0 or lower.

Poor: The aspect ratio was lower than 0.5 or higher than 5.0.

($d_B/d_{50}$)

The BET specific surface area $S_B$ ($m^2/g$) and true density ρ ($g/cm^3$) of the toner were measured with BET specific area measuring apparatus: NOVA4200e (trade name) manufactured by Yuasa Ionics Inc. and, from the measurement results obtained, the reduced particle size dg (μm) was determined by using the following expression (1). The values of BET specific surface area $S_B$, true density ρ and $d_B$ of the toner produced in each of Examples 1 to 3 and Comparative Examples 1 to 7 are shown in Table 24

$$dB=6/(\rho \cdot S_B) \quad (1)$$

The resultant mixture was subjected to 3 minutes' dispersion processing at an ultrasonic frequency of 20 kHz by means of an ultrasonic dispersing machine: UH-50 (trade name) manufactured by SMT Co., Ltd. Thus, a measuring sample was prepared. And volume particle-size distribution of the measuring sample was determined by using particle-size distribution measuring equipment: MULTISIZER III (trade name) manufactured by Beckman Coulter, Inc. under conditions that the aperture diameter was 20 μm and the number of measured particles was 50,000 counts. From the measurement result, the particle size $d_{50}$, which was a particle size corresponding to a cumulative volume of 50% from the greater particle-size side in cumulative volume distribution, was determined.

The value obtained by dividing the reduced particle size $d_B$ calculated from the expression (1) by $d_{50}$ (the value of $d_B/d_{50}$) was evaluated on the following criterion.

Good: The value of $d_B/d_{50}$ was 0.5 or above.

Poor: The value of $d_B/d_{50}$ was lower than 0.5.

TABLE 2

| | $S_B$ ($m^2/g$) | ρ ($g/cm^3$) | $d_B$ (μm) |
|---|---|---|---|
| Example 1 | 0.85 | 1.21 | 5.83 |
| Example 2 | 0.89 | 1.20 | 5.62 |
| Example 3 | 0.97 | 1.20 | 5.18 |
| Comparative Example 1 | 0.96 | 1.21 | 5.17 |
| Comparative Example 2 | 0.68 | 1.21 | 7.31 |
| Comparative Example 3 | — | — | — |
| Comparative Example 4 | — | — | — |

TABLE 2-continued

| | $S_B$ ($m^2/g$) | ρ ($g/cm^3$) | $d_B$ (μm) |
|---|---|---|---|
| Comparative Example 5 | 0.99 | 1.21 | 5.01 |
| Comparative Example 6 | 1.19 | 1.20 | 4.21 |
| Comparative Example 7 | 1.56 | 1.20 | 3.21 |

(Number of Reentrants)

Toner matrix particles were photographed with an electron microscope: VE-9500 (trade name) manufactured by KEYENCE CORPORATION, set at a magnification of 5,000. On the electron micrograph thus taken, 100 toner matrix particles were randomly selected, and the number of reentrants present in the surface of each toner matrix particle in the contour region in a longitudinal direction of each toner particle and the length of each reentrant in the minor axis direction were determined. And the number of reentrants whose lengths in the minor direction were greater than the radii of large particles of an external additive (hereinafter referred to as the number of reentrants) was determined. By averaging the values obtained, the number of reentrants per toner matrix particle was worked out. The number of reentrants thus obtained was evaluated on the following criterion.

Good: The number of reentrants per toner matrix particle was 10 or below.

Poor: The number of reentrants per toner matrix particle was greater than 10.

(State of Release Agent)

In a 2-liter beaker, 1,425 g of n-hexane (manufactured by Kishida Chemical Co., Ltd.) and a stirring bar were placed. Into the beaker, 75 g of toner matrix particles were poured while the n-hexane is stirred for 10 seconds with a stirrer. By this treatment, the release agent exposed at the toner matrix particle surface was removed. Thereafter, the thus treated toner matrix particles were photographed with an electron microscope: VE-9500 (trade name) manufactured by KEYENCE CORPORATION, set at a magnification of 5,000. On the electron micrograph thus taken, 100 toner matrix particles were randomly selected. In the bottom surface of the 100 toner matrix particles each, the area $S_A$ of each of reentrants where the dispersed release agent is present was measured, and the number of such reentrants was counted. The area $S_A$ of each reentrant corresponds to the area $S_A$ of each release agent spot. From the measurement results, the number of release agent spots each having an area $S_A$ of $2.5\times10^5$ $nm^2$ or above was counted. By averaging the values obtained, the number of release agent spots each having an area $S_A$ of $2.5\times10^5$ $nm^2$ or above per toner matrix particle was determined, and the number determined was evaluated on the following criterion.

Good: Every release agent spot present in one toner matrix particle had an area $S_A$ of $2.5\times10^5$ $nm^2$ or below, or the number of release agent spots each having an area $S_A$ of $2.5\times10^5$ $nm^2$ or above is at most 2 per toner matrix particale.

Poor: The number of release agent spots each having an area $S_A$ of $2.5\times10^5$ $nm^2$ or above was greater than 2 per toner matrix particle.

(Embedability of External Additive)

After a toner was stirred for one hour in a developing unit, toner matrix particle surfaces were observed under an electron microscope: VE-9500 (trade name) manufactured by KEYENCE CORPORATION, and examined for an embedded state of an external additive used. The embedability of an external additive was evaluated on the following criterion.

Good: The external additive was not embedded in any of reentrants.

Not Bad: The external additive was not embedded in any of reentrants, but it was deposited on some reentrants.

Poor: The external additive was embedded in at least reentrants.

(Electrostatic Charge Stability)

A developer was set in a developing unit of a commercially available copier having a two-component developing device: MX2300G (trade name) manufactured by Sharp Corporation, and only the developing device was operated continuously for 3 minutes in a state of being kept at 20° C. and adjusted so as not to develop any image on a photoreceptor. Then, the developer was collected, and the amount of initial electrostatic charge thereon ($Q_1$) is measured with suction electrostatic measurement apparatus: 210HS-2A Q/M METER (trade name) manufactured by TREK INC. In the same way, the developing device is further operated continuously for 2 hours and the amount of electrostatic charge on the resultant developer ($Q_2$) was measured. And a difference between $Q_1$ and $Q_2$ was calculated, and this difference value was evaluated on the following criterion.

Good: The difference between $Q_1$ and $Q_2$ was at most 20% of the amount of initial electrostatic charge $Q_1$.

Poor: The difference between $Q_1$ and $Q_2$ was greater than 20% of the amount of initial electrostatic charge $Q_1$.

(Flowability)

By the measured value of apparent density measurement made in conformance with JIS K5101-12-1, flowability was evaluated on the following criterion.

Good; Flowability was 0.40 or above.

Not Bad: Flowability was lower than 0.40.

(Yield)

The toner yield (%) was calculated by the following expression (3), wherein the weight of a raw material mixture charged into the raw material inlet of toner manufacturing apparatus in the kneading step was symbolized by $W_0$ (kg) and the weight of toner manufactured by undergoing the pulverizing step was symbolized by W (kg).

$$\text{Toner yield}(\%)-(W_1\,(kg)/W_0\,(kg))\times100 \quad (3)$$

The toner yield was evaluated on the following criterion.

Good: The toner yield was 85% or above.

Not Bad: The toner yield was from 70% to lower than 85%.

Poor: The toner yield was lower than 70%.

(Particle Size Distribution)

In a 100-ml beaker, 50 ml of an electrolytic solution: ISOTON-II (trade name) manufactured by Beckman Coulter, Inc. was put. Thereto, 20 mg of a sample and 1 ml of sodium alkyl ether sulfate (a dispersant, manufactured by Kishida Chemical Co., Ltd.) were added. The resultant mixture was subjected to 3 minutes' dispersion processing at an ultrasonic frequency of 20 kHz by means of an ultrasonic dispersing machine; UH-50 (trade name) manufactured by SMT Co., Ltd. Thus, a measuring sample was prepared. And volume particle-size distribution of the measuring sample was determined by using particle-size distribution measuring equipment: MULTISIZER III (trade name) manufactured by Beckman Coulter, Inc. under conditions that the aperture diameter was 100 μm and the number of measured particles was 50,000 counts. From the measurement result, the particle size $D_{50V}$, which was a particle size corresponding to a cumulative volume of 50% from the greater particle-size side in cumulative volume distribution, was worked out as the volume average particle size (μm). In addition, the standard deviation in the volume particle-size distribution was determined, and the coefficient of variation (CV value, %) was calculated by the following expression (4). A smaller coefficient of variation means a narrower particle-size distribution.

$$\text{CV value}(\%)=\{\text{Standard deviation in volume particle-size distribution}/\text{Volume average particle size}\ (\mu m)\}\times 100 \quad (4)$$

From the volume average particle size (μm) and the CV value (%), the particle size distribution was evaluated on the following criteria.

Good: The volume average particle size was from 5.0 μm to 10.0 μm and the CV value was smaller than 30%.

Not Bad: The volume average particle size was from 5.0 μm to 10.0 μm and the CV value was from 30% to smaller than 40%.

Poor: The volume average particle size was smaller than 5.0 μm or larger than 10.0 μm, or the CV value was 40% or above.

Results of evaluating in the foregoing way the aspect ratio, the surface smoothness ($d_B/d_{50}$, number of reentrants), the state of a release agent, the embedability of an external additives the electrostatic charge stability, the flowability and the particle size distribution are shown in Table 3-1 and Table 3-2. Incidentally, evaluation results shown in Table 3 are represented by the marks "Good", "Not Bad" and "Poor" used in explanations of the criteria. More specifically, "Good" represents excellence, "Not Bad" practicability, and "Poor" difficulty of practical use.

TABLE 3

| | Aspect Ratio | | $d_B/d_{50}$ | | Number of | State of | Embedability of | Electrostatic Charge |
|---|---|---|---|---|---|---|---|---|
| | Measured Value | Evaluation | Calculated Value | Evaluation | Reentrants Evaluation | Release Agent Evaluation | External Additive Evaluation | Stability Evaluation |
| Example 1 | 1.2 | Good | 0.75 | Good | Good | Good | Good | Good |
| Example 2 | 0.7 | Good | 0.57 | Good | Good | Good | Good | Good |
| Example 3 | 1.4 | Good | 0.88 | Good | Good | Good | Good | Good |
| Comparative Example 1 | — | — | 0.89 | Good | Good | Good | Good | Good |
| Comparative Example 2 | 0.7 | Good | 0.89 | Good | Good | Good | Good | Good |
| Comparative Example 3 | — | — | — | — | — | — | — | — |
| Comparative Example 4 | — | — | — | — | — | — | — | — |
| Comparative Example 5 | 0.4 | Poor | 0.90 | Good | Good | Good | Good | Good |
| Comparative Example 6 | 5.5 | Poor | 0.69 | Good | Good | Good | Good | Good |
| Comparative Example 7 | — | — | 0.49 | Poor | Poor | Poor | Poor | Poor |

| | Flowability | | Yield | | Particle Size Distribution | | | |
|---|---|---|---|---|---|---|---|---|
| | Measured Value | Evaluation | Yield (%) | Evaluation | Volume Average Particle Size (μm) | CV Value (%) | Evaluation | Comprehensive Evaluation |
| Example 1 | 0.41 | Good | 92 | Good | 7.8 | 23 | Good | Good |
| Example 2 | 0.43 | Good | 85 | Good | 9.8 | 25 | Good | Good |
| Example 3 | 0.40 | Good | 83 | Not Bad | 5.9 | 21 | Good | Not Bad |
| Comparative Example 1 | 0.38 | Not bad | 53 | Poor | 5.8 | 34 | Not Bad | Poor |
| Comparative Example 2 | 0.42 | Good | 81 | Not Bad | 10.6 | 37 | Poor | Poor |
| Comparative Example 3 | — | — | — | — | — | — | — | Poor |
| Comparative Example 4 | — | — | — | — | — | — | — | Poor |
| Comparative Example 5 | 0.38 | Not Bad | 73 | Poor | 5.5 | 34 | Not Bad | Poor |
| Comparative Example 6 | 0.38 | Not Bad | 45 | Poor | 6.1 | 37 | Not Bad | Poor |
| Comparative Example 7 | 0.37 | Not Bad | — | — | 6.5 | 23 | Good | Poor |

As can be seen from the results shown in Tables 3-1 and 3-2, the toner produced in each of Examples 1 to 3 was small-particle toner highly stable in properties including flowability and chargeability, compared with the toner produced in each of Comparative Examples 1 to 7.

More specifically, the toner of Examples 1 to 3 each was toner produced by the spinning method, and the toner produced had its aspect ratio in a range of 0.5 to 5.0, and further had a value $d_B/d_{50}$ not lower than 0.5. Therefore, the toner produced had toner matrix particles excellent in surface smoothness and was highly stable in flowability and chargeability with particles excellent in size uniformity.

On the other hand, the toner of Comparative Example 1 had a great coefficient of variation in the fiber diameter of the fibrous kneaded product, or a dispersion in the fiber diameters. Therefore, the toner matrix particles exhibited a wide range of aspect ratio variations and it was impossible to determine the aspect ratio. So, the toner obtained had particles nonuniform in size with unstable flowability and chargeability. In addition, the yield of the toner was so low as 45%.

In the case of the toner of Comparative Example 2, the fiber diameter of the fibrous kneaded product was great, so the toner produced was large-diameter toner having a volume average particle size greater than 10.0 μm. In other words, the toner produced didn't have desirable particle sizes.

In the case of the toner of Comparative Example 3, the fibrous kneaded product had a loss elastic modulus G" smaller than $10^1$ Pa at 200° C. and a loss tangent (tan δ) greater than 10 at 200° C. because the different binder resin was used. As a result, the fibrous kneaded product was difficult to pulverize in the pulverizing step and the toner produced was poor in surface smoothness. Therefore, variations in aspect ratio and those in $d_B/d_{50}$ were great, and it was impossible to determine them. Thus, the toner produced had particles nonuniform in size with unstable chargeability and flowability.

In the case of the toner of Comparative Example 4, the fibrous kneaded product had a loss elastic modulus G" greater than $10^5$ Pa at 120° C. because the different binder resin was used. As a result, the kneaded product was difficult to spin into fiber in the spinning step, so the toner produced was poor in surface smoothness. Accordingly, the fibrous kneaded product exhibited a wide range of aspect ratio variation and a wide range of $d_B/d_{50}$ variation, so it was impossible to determine them. And the toner produced had particles nonuniform in size with unstable chargeability and flowability.

The toner of Comparative Example 5 had a small aspect ratio of 0.4 μm because the pulverization and the classification in the pulverizing step were carried out under the condition that the number of revolutions of the classifying rotor was 8,200 rpm, and the toner had particles nonuniform in size. In addition, evaluation results on the flowability and yield of the toner produced were not good.

The toner of Comparative Example 6 had a great coefficient of variation in the fiber diameter of the fibrous kneaded product, or a dispersion in the fiber diameters. Therefore, the toner had a great aspect ratio of 5.5, and it had particles nonuniform in size with unstable flowability and chargeability. In addition, the yield of the toner was so low as 45%.

The toner of Comparative Example 7 was a toner produced by the kneading pulverization method, so it had a low $d_B/d_{50}$ value of 0.49 and was inferior in surface smoothness. Therefore, results on electrostatic charge stability and flowability were also undesirable, and chargeability and flowability of the toner were unstable.

As illustrated above, the toner produced in each of Examples 1 to 3 according to the invention is a toner having columnar toner matrix particles manufactured through: a kneading step of melt-kneading toner raw materials including at least binder resin, colorant and a release agent to prepare a kneaded product; a spinning step of extruding the kneaded product from orifices disposed at the tip of a spinning nozzle to prepare a fibrous kneaded product; and a pulverizing step of cutting or pulverizing the fibrous kneaded product, the columnar toner matrix particles each having the aspect ratio of 0.5 or more and 5.0 or less and the $d_B/d_{50}$ value of 0.5 or above. Therefore, the toner matrix particles have excellent surface smoothness, and the toner is highly stable in properties including flowability and chargeability, with particles excellent in size uniformity.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner comprising columnar toner matrix particles manufactured through: a kneading step of melt-kneading toner raw materials including at least a binder resin, a colorant and a release agent to thereby prepare a kneaded product; a spinning step of extruding the kneaded product from orifices disposed at a tip of a spinning nozzle to thereby prepare a fibrous kneaded product; and a pulverizing step of cutting or pulverizing the fibrous kneaded product, the columnar toner matrix particles each having an aspect ratio H/L of 0.5 or more and 5.0 or less where L represents a length of longitudinal bottom surface of each of the columnar toner matrix particles and H represents a height of the respective columnar toner matrix particles, the columnar toner matrix particles having $d_B/d_{50}$ of 0.5 or above where $d_B$ represents a reduced particle size determined from a BET specific surface area and a true density and $d_{50}$ represents a particle size corresponding to a cumulative volume of 50% counted from a greater particle-size side in cumulative volume distribution, the toner further comprising an external additive composed of large particles and small particles having a volume average particle size smaller than that of the large particles, and the columnar toner matrix particles each having, in a surface thereof, 10 or less reentrants whose apertures have a longer length in a minor axis thereof than a radius of the respective large particles.

2. The toner of claim 1, wherein the fibrous kneaded product has a loss elastic modulus G" of $10^5$ Pa or below at 120° C. and a loss elastic modulus G" of $10^1$ Pa or above at 200° C., and besides, the fibrous kneaded product has a loss tangent of 10 or below, where the loss tangent is defined as a value obtained by dividing the loss elastic modulus G" at 200° C. by a storage elastic modulus G' at 200° C.

3. The toner of claim 1, wherein content of the colorant is 10% by weight or below based on total raw materials of the toner.

4. The toner of claim 1, wherein all of $S_A$ is $2.5\times10^5$ $nm^2$ or below, or the number of $S_A$ of $2.5\times|10^5$ $nm^2$ or above is two or less in a bottom surface of one toner matrix particle, where $S_A$ represents an area of a dispersed release agent-existing spot in a bottom surface of each of the columnar toner matrix particles.

5. A two~component developer comprising the toner of claim 1 and a carrier.

* * * * *